US011186463B1

(12) United States Patent
Franklin-Hensler et al.

(10) Patent No.: US 11,186,463 B1
(45) Date of Patent: Nov. 30, 2021

(54) PIPE COIL DEPLOYMENT DRUM WITH INDEPENDENT PADDLE MOVEMENT SYSTEMS AND METHODS

(71) Applicant: Trinity Bay Equipment Holdings, LLC, Houston, TX (US)

(72) Inventors: Timothy John Franklin-Hensler, Houston, TX (US); Jonathan Guerrero, Houston, TX (US); Matthew Allen Hegler, Houston, TX (US); John Paul Leger, Baytown, TX (US); Peter Andrew Parker, Beech Creek, PA (US); Kraig Tabor, Houston, TX (US); Jagtar Singh Thethy, Cypress, TX (US); Alexander Lee Winn, Houston, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

(21) Appl. No.: 17/221,880

(22) Filed: Apr. 5, 2021

(51) Int. Cl.
*B65H 75/22* (2006.01)
*B65H 75/44* (2006.01)
*B65H 16/06* (2006.01)

(52) U.S. Cl.
CPC ..... *B65H 75/4468* (2013.01); *B65H 16/06* (2013.01); *B65H 2301/4134* (2013.01); *B65H 2301/415085* (2013.01); *B65H 2404/1114* (2013.01); *B65H 2511/142* (2013.01); *B65H 2601/325* (2013.01); *B65H 2701/33* (2013.01)

(58) Field of Classification Search
CPC .. B65H 75/22; B65H 75/242; B65H 75/4468; B65H 2404/1114; B65H 2301/4134; B65H 2701/33
See application file for complete search history.

(56) References Cited

U.S. PATENT DOCUMENTS

| | | | | |
|---|---|---|---|---|
| 8,985,496 | B2 * | 3/2015 | Dillinger | B65H 49/30 242/577 |
| 10,822,194 | B1 * | 11/2020 | Hegler | B65H 75/242 |
| 10,941,015 | B1 * | 3/2021 | Matari | B65H 75/22 |
| 2019/0257445 | A1 * | 8/2019 | Case | F16L 1/203 |
| 2020/0324997 | A1 * | 10/2020 | Garcia | B65H 75/20 |
| 2021/0206596 | A1 * | 7/2021 | Matari | B65H 75/241 |

OTHER PUBLICATIONS https://www.woodworkingshop.com/product/ht50000/; Jan. 10, 2019.

* cited by examiner

*Primary Examiner* — Sang K Kim
(74) *Attorney, Agent, or Firm* — Conrad J. Hsu

(57) ABSTRACT

Techniques for implementing and/or operating a pipe deployment system that includes pipe deployment equipment, which facilitates deploying a pipe segment from a pipe coil, and a pipe drum, which includes a drum body around which the pipe coil is to be disposed. The pipe drum is to be disposed on the pipe deployment equipment and the drum body includes a drum core as well as a lower paddle assembly and an upper paddle assembly, which are slidably secured to the drum core. The pipe deployment system maintains the paddle assemblies in a retracted state to enable the drum body to be inserted into the pipe coil, extends the lower paddle assembly to a more extended state to facilitate raising the drum core, and retracts the lower paddle assembly to a less extended state and extends the upper paddle assembly to the less extended state to facilitate lifting the pipe coil.

17 Claims, 14 Drawing Sheets

PIPE COIL DEPLOYMENT DRUM WITH INDEPENDENT PADDLE MOVEMENT SYSTEMS AND METHODS

BACKGROUND

The present disclosure generally relates to pipeline systems and, more particularly, to a pipe drum that may be used to facilitate deploying one or more pipe segments from a pipe coil into a pipeline system.

Pipeline systems are often used to transport (e.g., convey) fluid, such as liquid and/or gas, from a fluid source to a fluid destination. For example, a pipeline system may be used to transport one or more hydrocarbons, such as crude oil, petroleum, natural gas, or any combination thereof. Additionally or alternatively, a pipeline system may be used to transport one or more other types of fluid, such as produced water, potable water, fresh water, fracturing fluid, flowback fluid, carbon dioxide, or any combination thereof.

To facilitate transporting fluid, a pipeline system may include one or more pipe segments in addition to pipe (e.g., midline and/or end) fittings, which are used to connect a pipe segment to another pipeline component, such as another pipe fitting, another pipe segment, a fluid source, and/or a fluid destination. Generally, a pipe segment includes tubing, which defines (e.g., encloses) a pipe bore that provides a primary fluid conveyance (e.g., flow) path through the pipe segment. More specifically, the tubing of a pipe segment may be implemented to facilitate isolating (e.g., insulating) fluid being conveyed within its pipe bore from environmental conditions external to the pipe segment, for example, to reduce the likelihood of the conveyed (e.g., bore) fluid being lost to the external environmental conditions and/or the external environmental conditions contaminating the conveyed fluid (e.g., clean and/or potable water).

Additionally, in some instances, a pipe segment to be deployed in a pipeline system may be flexible and, thus, spooled (e.g., coiled, wrapped, and/or wound) on a pipe drum to form a pipe coil before being deployed in the pipeline system. Furthermore, in some such instances, a pipe deployment system may be implemented and/or operated to deploy a pipe segment in a pipe coil from a pipe drum into a pipeline system, for example, at least in part by exerting pulling force on a free (e.g., unspooled) end of the pipe segment to unspool more of the pipe segment off of the pipe drum. However, at least in some instances, pipe segments from multiple different pipe coils may be deployed in a pipeline system. Since a pipe drum may effectively be tied (e.g., fixed) to a pipe coil when its outer surface is engaged with an inner surface of the pipe coil, at least in such instances, utilizing a pipe drum with fixed outer surface diameters in a pipe deployment system may potentially limit implementation-associated cost of the pipe deployment system, for example, at least in part by limiting the minimum number of pipe drums utilized in the pipe deployment system to deploy the pipeline system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one embodiment, a pipe deployment system includes pipe deployment equipment, which facilitates deploying a pipe segment that includes tubing that defines a pipe bore and a fluid conduit within an annulus of the tubing from a pipe coil into a pipeline system, and a pipe drum, which includes a drum body around which the pipe coil is to be disposed. The pipe drum is to be disposed on an equipment frame of the pipe deployment equipment and the drum body includes a drum core, a lower paddle assembly slidably secured to the drum core, and an upper paddle assembly slidably secured to the drum core. The pipe deployment system maintains the lower paddle assembly and the upper paddle assembly in a retracted state to enable the drum body to be inserted into an interior channel of the pipe coil, extends the lower paddle assembly from the retracted state to a more extended state while maintaining the upper paddle assembly in the retracted state to facilitate raising a drum shaft included in the drum core of the drum body, and retracts the lower paddle assembly from the more extended state to a less extended state and extends the upper paddle assembly from the retracted state to the less extended state to facilitate lifting the pipe coil disposed on the drum body off of the equipment frame of the pipe deployment equipment.

In another embodiment, a method of operating a pipe deployment system includes maintaining a lower paddle assembly and an upper paddle assembly of a pipe drum included in the pipe deployment system in a retracted state to enable a drum body of the pipe drum to be inserted into an interior channel of a pipe coil, extending the lower paddle assembly from the retracted state to a more extended state while maintaining the upper paddle assembly in the retracted state to facilitate inserting a drum shaft of the drum body into a shaft opening in a drum flange of the pipe drum at least in part by raising the drum shaft, securing the drum flange to the drum body at least in part by securing the drum shaft of the drum body in the shaft opening of the drum flange, and retracting the lower paddle assembly from the more extended state to a less extended state and extending the upper paddle assembly from the retracted state to the less extended state to facilitate lifting the pipe coil disposed around the drum body.

In another embodiment, a pipe drum includes a drum body, in which a pipe coil is configured to be disposed around the drum body, and a drum flange to be selectively secured to the drum body to facilitate retaining the pipe coil on the drum body. The drum body includes an axial support bar, a drum shaft that extends out from the axial support bar, drum paddles that define an outer surface diameter of the drum body, expandable body spokes that secure the plurality of drum paddles to the axial support bar, and fluid actuators secured between the axial support bar and inner surfaces of the drum paddles to enable the outer surface diameter of the drum body to be adaptively adjusted. The drum flange includes an L-shaped shaft opening that interfaces with the drum shaft of the drum body to facilitate securing the drum flange to the drum body.

DETAILED DESCRIPTION

Figure 1:
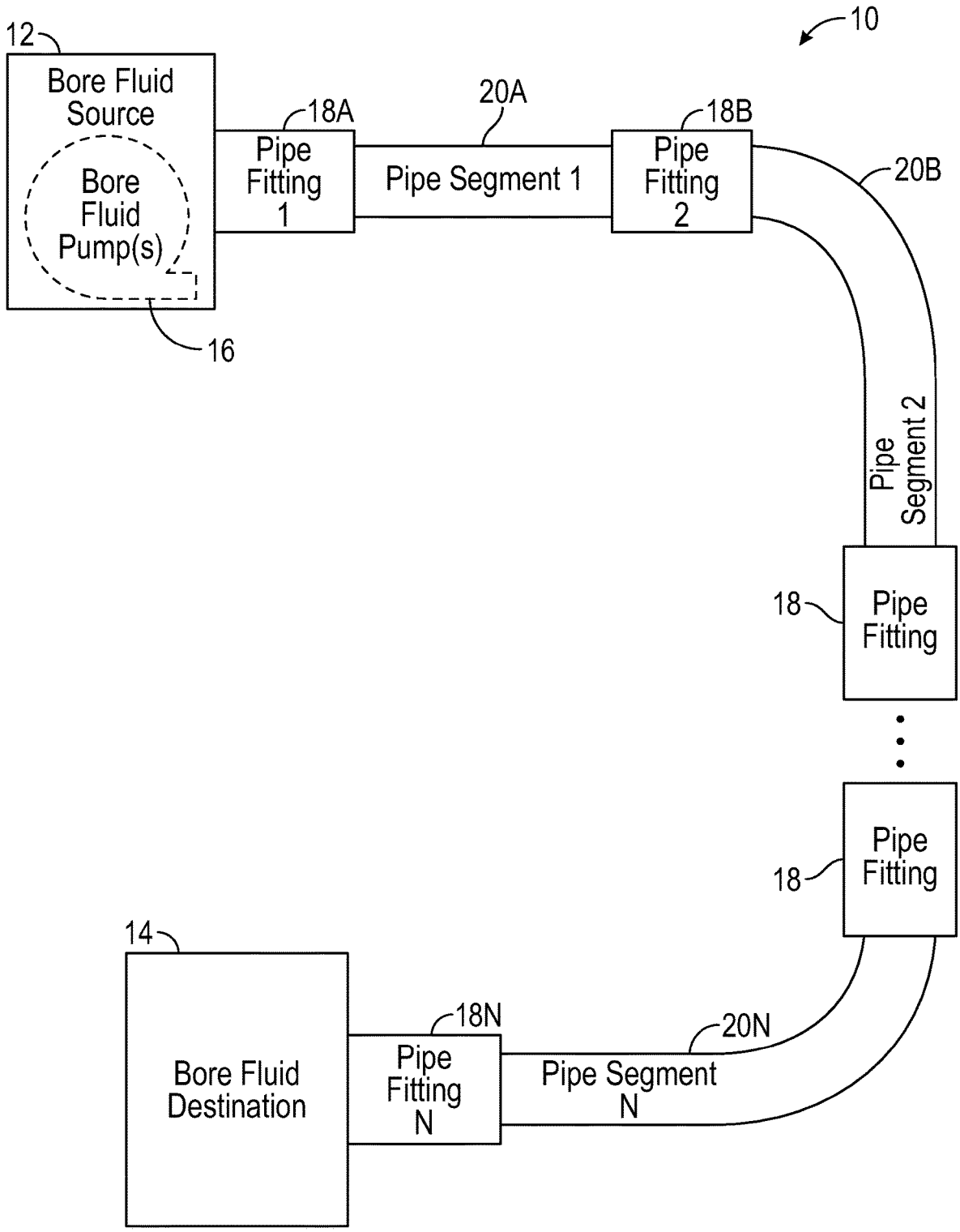
FIG. 1 is a block diagram of an example of a pipeline system including pipe segments and pipe fittings, in accordance with an embodiment of the present disclosure.

One or more specific embodiments of the present disclosure will be described below with reference to the figures. As used herein, the term "coupled" or "coupled to" may indicate establishing either a direct or indirect connection and, thus, is not limited to either unless expressly referenced as such. The term "set" may refer to one or more items. Wherever possible, like or identical reference numerals are used in the figures to identify common or the same features. The figures are not necessarily to scale. In particular, certain features and/or certain views of the figures may be shown exaggerated in scale for purposes of clarification.

The present disclosure generally relates to pipeline systems that may be implemented and/or operated to transport (e.g., convey) fluid, such as liquid and/or gas, from a fluid source to a fluid destination. Generally, a pipeline system may include pipe fittings, such as a midline pipe fitting and/or a pipe end fitting, and one or more pipe segments. More specifically, a pipe segment may generally be secured and sealed in one or more pipe fittings to facilitate fluidly coupling the pipe segment to another pipeline component, such as another pipe segment, another pipe fitting, a fluid source, and/or a fluid destination. Merely as an illustrative non-limiting example, a pipeline system may include a first pipe end fitting secured to a first pipe segment to facilitate fluidly coupling the first pipe segment to the fluid source, a midline pipe fitting secured between the first pipe segment and a second pipe segment to facilitate fluidly coupling the first pipe segment to the second pipe segment, and a second pipe end fitting secured to the second pipe segment to facilitate fluidly coupling the second pipe segment to the fluid destination.

In any case, a pipe segment generally includes tubing that defines (e.g., encloses) a pipe bore, which provides a primary fluid conveyance (e.g., flow) path through the pipe segment. More specifically, the tubing of a pipe segment may be implemented to facilitate isolating environmental conditions external to the pipe segment from conditions within its pipe bore and, thus, fluid that flows therethrough. In particular, the tubing of a pipe segment may primarily be implemented to block fluid flow directly between the pipe bore of the pipe segment and its external environmental conditions, for example, in addition to providing thermal, pressure, and/or electrical isolation (e.g., insulation).

Furthermore, in some instances, a pipe segment may be flexible. In fact, in some such instances, the pipe segment may be formed into a pipe coil with an interior channel, for example, for transport and/or storage. Merely as an illustrative non-limiting example, a pipe coil may be formed at least in part by spooling (e.g., wrapping and/or winding) one or more pipe segments onto a pipe drum such that an outer surface of the pipe drum engages an inner surface of the pipe coil, thereby securing the pipe drum to the pipe coil.

In fact, in some instances, a pipe deployment system may be implemented and/or operated to deploy a pipe segment from a pipe coil, which is disposed on a pipe drum, into a pipeline system. In particular, in such instances, the pipe drum and the pipe coil may be loaded on pipe deployment equipment in the pipe deployment system, such as a pipe deployment trailer or a pipe deployment cradle. The pipe deployment system may then operate to exert pulling force on a free (e.g., unspooled) section of the pipe segment to facilitate unspooling more of the pipe segment off of the pipe drum, for example, using a tow vehicle secured to the free section of the pipe segment via a pulling device.

However, at least in some instances, pipe segments from multiple different pipe coils may be deployed in a pipeline system. As described above, a pipe drum may be secured to a pipe coil when its outer surface is engaged with the inner surface of the pipe coil. Thus, at least in such instances, utilizing fixed outer surface diameter pipe drums in a pipe deployment system may potentially limit implementation-associated cost, such as component count and/or physical footprint, of the pipe deployment system, for example, at least in part by limiting the minimum number of pipe drums utilized in the pipe deployment system to deploy the pipeline system.

Accordingly, to facilitate reducing pipe deployment cost, the present disclosure provides techniques for implementing and/or operating a pipe deployment system that includes a pipe drum with an adaptively (e.g., dynamically and/or selectively) adjustable outer surface diameter, for example, which may enable the same pipe drum to be used with multiple different pipe coils and, thus, reducing the number of pipe drums included in the pipe deployment system. As will be described in more detail below, a pipe drum in a pipe deployment system may generally include a drum body on which a pipe coil is to be disposed. In some embodiments, the pipe drum may additionally include drum flanges, which are implemented to be secured to the drum body such that the drum flanges are disposed on either side of the pipe coil and, thus, facilitate retaining the pipe coil on the drum body. Nevertheless, in other embodiments, a pipe drum may not include drum flanges.

In any case, to facilitate adaptively adjusting its outer surface diameter, the drum body of a pipe drum may include an axial (e.g., central) support bar, multiple drum paddles that define the outer surface diameter of the drum body, and multiple expandable drum spokes that secure the drum paddles to the axial support bar. The drum body may additionally include drum shafts that extend out from the axial support bar, for example, to enable a corresponding pipe coil to rotate about a central axis and/or to facilitate securing drum flanges to the drum body. Furthermore, the expandable drum spokes of the drum body may each include a female section, which is secured to the axial support bar, and a male section, which is implemented to move telescopically within the female section.

Thus, in some embodiments, the drum body of a pipe drum may actually be implemented as paddle (e.g., arm) assemblies, which each includes a drum paddle and the male sections of one or more expandable drum spokes that are secured to the drum paddle, and a drum core, which includes its axial support bar and the female sections of its expandable drum spokes, for example, in addition to its drum shafts and circumferential support bars that are secured between adjacent expandable drum spoke female sections. Merely as an illustrative non-limiting example, on a first side of the axial support bar, the drum core may include a first expandable drum spoke female section secured to the axial support bar, an Nth expandable drum spoke female section secured to the axial support bar, and a circumferential support bar secured between the first expandable drum spoke female section and the Nth expandable drum spoke female section while, on a second (e.g., opposite) side of the axial support bar, the drum core may include an N+1th expandable drum spoke female section secured to the axial support bar, a 2Nth expandable drum spoke female section secured to the axial support bar, and another circumferential support bar secured between the N+1th expandable drum spoke female section and the 2Nth expandable drum spoke female section. Additionally, a first paddle assembly may include a first drum paddle, a first expandable drum spoke male section secured to the first drum paddle, and an N+1th expandable drum spoke male section secured to the first drum paddle while an Nth paddle assembly may include an Nth drum paddle, an Nth expandable drum spoke male section secured to the Nth drum paddle, and a 2Nth expandable drum spoke male section secured to the Nth drum paddle.

As such, extending the expandable drum spokes of a pipe drum such that its drum paddles move away from its axial support bar may increase the outer surface diameter of its drum body, for example, to facilitate engaging the outer surface of its drum body with the inner surface of a pipe coil and, thus, securing the pipe drum to the pipe coil. On the other hand, retracting the expandable drum spokes of the pipe drum such that its drum paddles move toward its axial support bar may decrease its outer surface diameter, for example, to facilitate disengaging its drum body from the pipe coil and, thus, withdrawing the drum body from the pipe coil. In this manner, a pipe drum may be implemented to enable the pipe drum to be selectively used with multiple different pipe coils.

To facilitate controlling movement of its paddle assemblies, a drum body of a pipe drum in a pipe deployment system may additionally include actuators. In some embodiments, an actuator of a drum body may be a fluid actuator, such as a hydraulic actuator, a pneumatic actuator, and/or a fluid bladder. Thus, to facilitate powering operation of the pipe drum, in such embodiments, the pipe deployment system may include a fluid power sub-system.

In any case, to facilitate moving its paddle assemblies, in some embodiments, a pipe drum may include a set of one or more actuators secured to each paddle assembly and its axial support bar. For example, the pipe drum may include a first actuator that is secured between its axial support bar and a first drum paddle of a first paddle assembly and, thus, the first actuator may be operated to facilitate selectively extending and/or selectively retracting the first paddle assembly. Similarly, the pipe drum may include an Nth actuator that is secured between its axial support bar and an Nth drum paddle of an Nth paddle assembly and, thus, the Nth actuator may be operated to facilitate selectively extending and/or selectively retracting the Nth paddle assembly.

However, in other embodiments, an actuator of a pipe drum may not be secured directly to a corresponding paddle assembly. For example, in some such embodiments, an actuator of the pipe drum may be secured to a slidable ring, which is secured around the axial support bar of the pipe drum, and a pivoting member may be secured to the slidable ring and an inward-facing surface of a drum paddle in a paddle assembly of the pipe drum. Thus, operating the actuator to move the slidable ring toward alignment with a securement point on the drum paddle may cause the paddle assembly to extend away from the axial support bar while operating the actuator to move the slidable ring away from alignment with the securement point on the drum paddle may cause the paddle assembly to retract toward the axial support bar.

In fact, in some such embodiments, multiple paddle assemblies of a pipe drum may be secured to a slidable ring via corresponding pivoting members. For example, a first pivoting member may be secured between the slidable ring and a first drum paddle of a first paddle assembly while an Nth pivoting member may be secured between the slidable ring and an Nth drum paddle of an Nth paddle assembly. Thus, in such embodiments, the pipe drum may be implemented to enable the first paddle assembly and the Nth paddle assembly to be concurrently extended and/or concurrently retracted.

Nevertheless, in some embodiments, a pipe deployment system may be implemented and/or operated to enable different paddle assemblies of a pipe drum to be moved independently. In other words, in such embodiments, the pipe drum may be implemented to enable different paddle assemblies to be moved at different times and/or to enable a paddle assembly to be extended while another paddle assembly is concurrently being retracted. In fact, in some embodiments, moving the paddle assemblies of a pipe drum independently may facilitate securing drum flanges to its drum body and/or loading a pipe coil on pipe deployment equipment, such as a pipe deployment trailer or a pipe deployment cradle.

In particular, in some embodiments, the drum body of a pipe drum may be inserted into an interior channel of a pipe coil while its paddle assemblies are in their retracted states. The drum body and the pipe coil may then be disposed between drum flanges, for example, after the drum flanges are disposed on pipe deployment equipment. The pipe deployment system may then operate to transition the lower set of one or more paddle assemblies of the pipe drum from their retracted states to their more (e.g., fully) extended states such that the drum shafts of the pipe drum are aligned with corresponding shaft openings in flange plates of the drum flanges.

In fact, to facilitate alignment with a drum shaft, in some embodiments, a flange plate of a drum flange may be implemented with an L-shaped shaft opening. In particular, in such embodiments, a leg section of the shaft opening may open to an edge of the flange plate to enable a drum shaft to slide therein as it is being raised. Additionally, a toe section of the shaft opening may be connected to and substantially perpendicular to the leg section to facilitate securing the drum shaft within the shaft opening.

In any case, once aligned, a drum shaft of a drum body may be secured in a shaft opening of a drum flange. In particular, in some embodiments, a drum shaft may be secured in an L-shaped shaft opening at least in part by pinning the drum shaft in a toe section of the shaft opening. However, in other embodiments, the drum shaft may be threaded and the shaft opening may be implemented with an enclosed (e.g., circular, rectangular, or the like) shaft opening. Thus, after the drum shaft is disposed within the shaft opening, in such embodiments, a flange nut may be tightened on the drum shaft, for example, such that an inward-facing surface of the drum flange is compressed against the side of a pipe coil disposed on the drum body.

Additionally or alternatively, to facilitate securing a drum shaft of a drum body in the shaft opening of a drum flange, in some embodiments, the drum shaft and a flange plate of the drum flange that defines the shaft opening may be implemented to matingly interlock. For example, in such embodiments, the drum shaft may be keyed with one or more flat outer surfaces while the flange plate of the drum flange is keyed with one or more corresponding flat inner surfaces. In fact, matingly interlocking the drum shaft with the drum flange in this manner may facilitate tying rotation of the drum flange with rotation of the drum body and, thus, rotation of a pipe coil disposed on the drum body.

To facilitate tying rotation of a drum flange with rotation of its drum body, in some embodiments, a pipe drum may additionally or alternatively include one or more anti-rotation pins, which are implemented to be connected to the drum flange and the drum body. For example, in some such embodiments, an anti-rotation pin may be implemented to be inserted between adjacent radial support bars (e.g., spokes) of the drum flange such that the anti-rotation pin is also disposed between adjacent expandable body spokes of the drum body. In other such embodiments, an anti-rotation pin may be implemented to be inserted and secured in a pin opening formed in the drum flange as well as another pin opening formed in the drum body.

In any case, after the drum body of a pipe drum is secured to its drum flanges, the pipe drum may be operated to lift a pipe coil disposed on the drum body, for example, to facilitate loading the pipe coil on pipe deployment equipment, such as a pipe deployment trailer or a pipe deployment cradle. In particular, to facilitate lifting the pipe coil, the pipe deployment system may operate to transition the lower set of one or more paddle assemblies of the pipe drum from their more (e.g., fully) extended states to their less (e.g., partially) extended states and to transition the upper set of one or more paddle assemblies of the pipe drum from their retracted states to their less extended states. In some embodiments, the pipe deployment system may operate to transition the lower set of one or more paddle assemblies of the pipe drum before transitioning the upper set of one or more paddle assemblies of the pipe drum. However, in other embodiments, the pipe deployment system operates to transition the lower set of one or more paddle assemblies and the upper set of one or more paddle assemblies of the pipe drum simultaneously (e.g., concurrently).

To enable transitioning a paddle assembly of a pipe drum in a pipe deployment system while concurrently transitioning another paddle assembly of the pipe drum in an opposite manner, in some embodiments, a fluid power sub-system in the pipe deployment system may include multiple actuation fluid pumps and multiple actuation fluid valves in addition to an actuation fluid reservoir. For example, in some such embodiments, the fluid power sub-system may include an actuation fluid pump and an actuation fluid valve dedicated to each fluid actuator in the pipe drum. However, to facilitate reducing component count and/or physical footprint, in other embodiments, actuation fluid pumps and actuation fluid valves in a fluid power sub-system may each be dedicated to a set of multiple fluid actuators. For example, the fluid power sub-system may include an actuation fluid pump and an actuation fluid valve, which are dedicated to actuators associated with a lower set of one or more paddle assemblies, as well as another actuation fluid pump and another actuation fluid valve, which are dedicated to actuators associated with an upper set of one or more paddle assemblies. In this manner, as will be described in more detail below, the present disclosure provides techniques for implementing and/or operating a pipe deployment system with a pipe drum that has an adaptively (e.g., dynamically and/or selectively) adjustable outer surface diameter, which, at least in some instances, may facilitate reducing implementation-associated cost (e.g., component count and/or physical footprint) of the pipe deployment system, for example, at least in part by enabling the same pipe drum to be used with multiple different pipe coils.

To help illustrate, an example of a pipeline system 10 is shown in FIG. 1. As in the depicted example, the pipeline system 10 may be coupled between a bore fluid source 12 and a bore fluid destination 14. Merely as an illustrative non-limiting example, the bore fluid source 12 may be a production well and the bore fluid destination 14 may be a fluid storage tank. In other instances, the bore fluid source 12 may be a first (e.g., lease facility) storage tank and the bore fluid destination 14 may be a second (e.g., refinery) storage tank.

In any case, the pipeline system 10 may generally be implemented and/or operated to facilitate transporting (e.g., conveying) fluid, such as gas and/or liquid, from the bore fluid source 12 to the bore fluid destination 14. In fact, in some embodiments, the pipeline system 10 may be used in many applications, including without limitation, both onshore and offshore oil and gas applications. For example, in such embodiments, the pipeline system 10 may be used to transport one or more hydrocarbons, such as crude oil, petroleum, natural gas, or any combination thereof. Additionally or alternatively, the pipeline system 10 may be used to transport one or more other types of fluid, such as produced water, fresh water, fracturing fluid, flowback fluid, carbon dioxide, or any combination thereof.

To facilitate flowing fluid to the bore fluid destination 14, in some embodiments, the bore fluid source 12 may include one or more bore fluid pumps 16 that are implemented and/or operated to inject (e.g., pump and/or supply) fluid from the bore fluid source 12 into a bore of the pipeline system 10. However, it should be appreciated that the depicted example is merely intended to be illustrative and not limiting. In particular, in other embodiments, a bore fluid pump 16 may not be implemented at the bore fluid source 12, for example, when fluid flow through the bore of the pipeline system 10 is produced by gravity. Additionally or alternatively, in other embodiments, one or more bore fluid pumps 16 may be implemented in the pipeline system 10 and/or at the bore fluid destination 14.

To facilitate transporting fluid from the bore fluid source 12 to the bore fluid destination 14, as in the depicted example, a pipeline system 10 may include one or more pipe fittings 18 and one or more pipe segments 20. For example, the depicted pipeline system 10 includes a first pipe segment 20A, a second pipe segment 20B, and an Nth pipe segment 20N. Additionally, the depicted pipeline system 10 includes a first pipe (e.g., end) fitting 18A, which couples the bore fluid source 12 to the first pipe segment 20A, a second pipe (e.g., midline) fitting 18B, which couples the first pipe segment 20A to the second pipe segment 20B, and an Nth pipe (e.g., end) fitting 18N, which couples the Nth pipe segment 20N to the bore fluid destination 14.

However, it should again be appreciated that the depicted example is merely intended to be illustrative and not limiting. In particular, in other embodiments, a pipeline system 10 may include fewer than three (e.g., one or two) pipe segments 20 or more than three (e.g., four, five, or more) pipe segments 20. Additionally or alternatively, in other embodiments, a pipeline system 10 may include fewer than four (e.g., one, two, or three) pipe fittings 18 or more than four (e.g., five, six, or more) pipe fittings 18.

In any case, as described above, a pipe segment 20 generally includes tubing that may be used to convey (e.g., transfer and/or transport) water, gas, oil, and/or any other suitable type of fluid. The tubing of a pipe segment 20 may be made of any suitable type of material, such as plastic, metal, and/or a composite (e.g., fiber-reinforced composite) material. In fact, as will be described in more detail below, in some embodiments, the tubing of a pipe segment 20 may be implemented using multiple different layers. For example, the tubing of a pipe segment 20 may include a first high-density polyethylene (e.g., internal corrosion protection) layer, one or more reinforcement (e.g., steel strip) layers external to the first high-density polyethylene layer, and a second high-density polyethylene (e.g., external corrosion protection) layer external to the one or more reinforcement layers.

Additionally, as in the depicted example, one or more (e.g., second and/or Nth) pipe segments 20 in a pipeline system 10 may be curved. To facilitate implementing a curve in a pipe segment 20, in some embodiments, the pipe segment 20 may be flexible, for example, such that the pipe segment 20 is spoolable on a pipe drum. In other words, in some embodiments, one or more pipe segments 20 in the pipeline system 10 may be a flexible pipe, such as a bonded flexible pipe, an unbonded flexible pipe, a flexible composite pipe (FCP), a thermoplastic composite pipe (TCP), or a reinforced thermoplastic pipe (RTP). In fact, at least in some instances, increasing the flexibility of a pipe segment 20 may facilitate improving deployment efficiency of a pipeline system 10, for example, by obviating a curved (e.g., elbow) pipe fitting 18 and/or enabling the pipe segment 20 to be transported to the pipeline system 10, deployed in the pipeline system 10, or both using a tighter spool.

To facilitate improving pipe flexibility, in some embodiments, the tubing of a pipe segment 20 that defines (e.g., encloses) its pipe bore may include one or more openings devoid of solid material. In fact, in some embodiments, an opening in the tubing of a pipe segment 20 may run (e.g., span) the length of the pipe segment 20 and, thus, define (e.g., enclose) a fluid conduit in the annulus of the tubing, which is separate from the pipe bore. In other words, in such embodiments, fluid may flow through a pipe segment 20 via its pipe bore, a fluid conduit implemented within its tubing annulus, or both.

Figure 2:
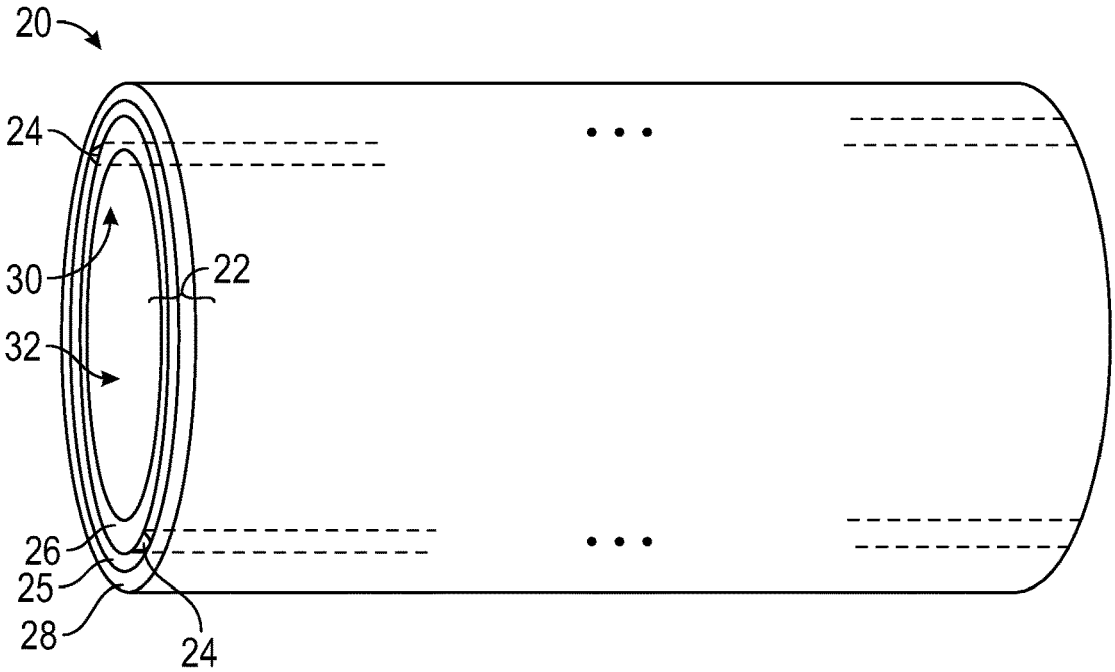
FIG. 2 is a side view of an example of a pipe segment of FIG. 1 that includes a pipe bore defined by its tubing as well as fluid conduits implemented within an annulus of its tubing, in accordance with an embodiment of the present disclosure.

To help illustrate, an example of a pipe segment 20, which includes tubing 22 with fluid conduits 24 implemented in a tubing annulus 25, is shown in FIG. 2. As depicted, the pipe segment tubing 22 is implemented with multiple layers including an inner barrier (e.g., liner and/or sheath) layer 26 and an outer barrier (e.g., shield and/or sheath) layer 28. In some embodiments, the inner barrier layer 26 and/or the outer barrier layer 28 of the pipe segment tubing 22 may be implemented using composite material and/or plastic, such as high-density polyethylene (HDPE), raised temperature polyethylene (PE-RT), cross-linked polyethylene (XLPE), polyamide 11 (PA-11), polyamide 12 (PA-12), polyvinylidene difluoride (PVDF), or any combination thereof. Although a number of particular layers are depicted, it should be understood that the techniques described in the present disclosure may be broadly applicable to composite pipe body structures including two or more layers, for example, as distinguished from a rubber or plastic single-layer hose subject to vulcanization. In any case, as depicted, an inner surface 30 of the inner barrier layer 26 defines (e.g., encloses) a pipe bore 32 through which fluid can flow, for example, to facilitate transporting fluid from a bore fluid source 12 to a bore fluid destination 14.

Additionally, as depicted, the annulus 25 of the pipe segment tubing 22 is implemented between its inner barrier layer 26 and its outer barrier layer 28. As will be described in more detail below, the tubing annulus 25 may include one or more intermediate layers of the pipe segment tubing 22. Furthermore, as depicted, fluid conduits 24 running along the length of the pipe segment 20 are defined (e.g., enclosed) in the tubing annulus 25. As described above, a fluid conduit 24 in the tubing annulus 25 may be devoid of solid material. As such, pipe segment tubing 22 that includes one or more fluid conduits 24 therein may include less solid material and, thus, exert less resistance to flexure, for example, as compared to solid pipe segment tubing 22 and/or pipe segment tubing 22 that does not include fluid conduits 24 implemented therein. Moreover, to facilitate further improving pipe flexibility, in some embodiments, one or more layers in the tubing 22 of a pipe segment 20 may be unbonded from one or more other layers in the tubing 22 and, thus, the pipe segment 20 may be an unbonded pipe.

However, it should be appreciated that the depicted example is merely intended to be illustrative and not limiting. In particular, in other embodiments, pipe segment tubing 22 may include fewer than two (e.g., one) or more than two (e.g., three, four, or more) fluid conduits 24 defined in its tubing annulus 25. Additionally or alternatively, in other embodiments, a fluid conduit 24 defined in a tubing annulus 25 of a pipe segment 20 may run non-parallel to the pipe bore 32 of the pipe segment 20, for example, such that the fluid conduit 24 is skewed relative to the longitudinal axis of the pipe bore 32.

Figure 3:
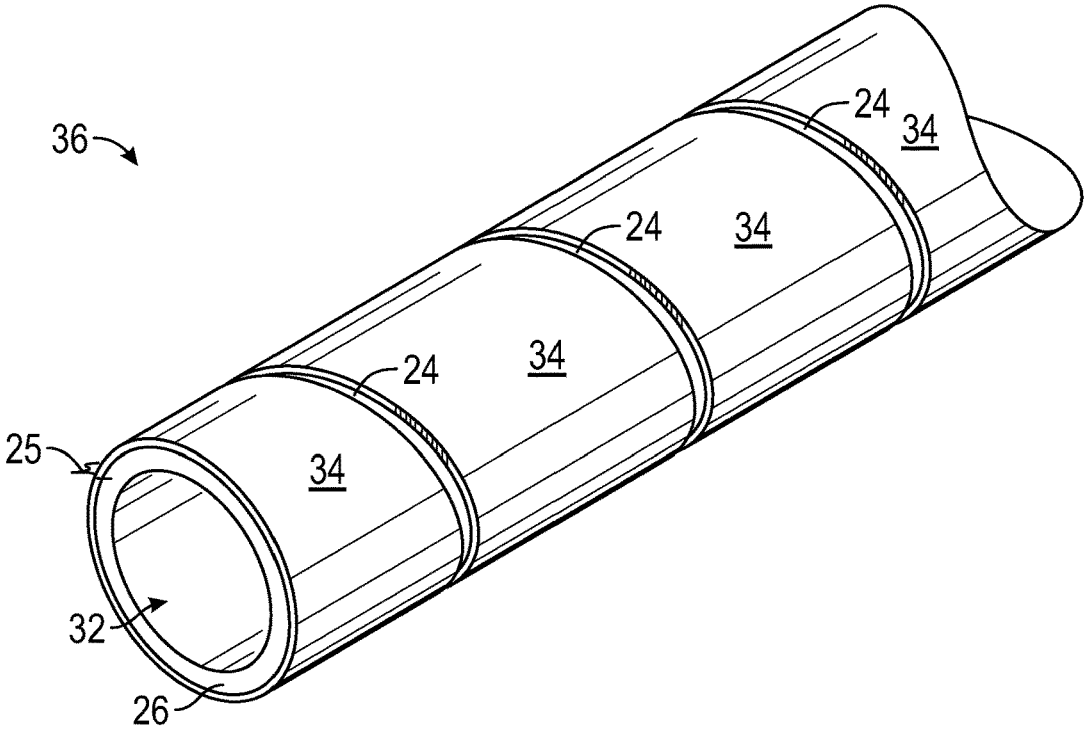
FIG. 3 is an example of a portion of the pipe segment of FIG. 2 with a helically shaped fluid conduit implemented within the annulus of its tubing, in accordance with an embodiment of the present disclosure.

To help illustrate, an example of a portion 36 of a pipe segment 20, which includes an inner barrier layer 26 and an intermediate layer 34 included in a tubing annulus 25 of its pipe segment tubing 22, is shown in FIG. 3. In some embodiments, one or more intermediate layers 34 of the pipe segment tubing 22 may be implemented using a solid material that has a higher tensile strength and/or a higher hoop strength as compared to a solid material used to implement the inner barrier layer 26. For example, the inner barrier layer 26 may be implemented using plastic, such as high-density polyethylene (HDPE), while an intermediate layer 34 is implemented using composite material and/or metal, such as carbon steel, stainless steel, duplex stainless steel, super duplex stainless steel, or any combination thereof. In other words, at least in some such embodiments, an intermediate layer 34 of the pipe segment tubing 22 may be implemented using electrically conductive, which, at least in some instances, may enable communication of electrical (e.g., test and/or return) signals via the intermediate layer 34.

In any case, as depicted, the intermediate layer 34 is helically disposed (e.g., wound and/or wrapped) on the inner barrier layer 26 such that gaps (e.g., openings) are left between adjacent windings to define a fluid conduit 24. In other words, in some embodiments, the intermediate layer 34 may be implemented at least in part by winding a solid strip of material around the inner barrier layer 26 at a non-zero lay angle (e.g., fifty-four degrees) relative to the longitudinal axis of the pipe bore 32. In any case, as depicted, the resulting fluid conduit 24 runs helically along the pipe segment 20, for example, such that the fluid conduit 24 is skewed fifty-four degrees relative to the longitudinal axis of the pipe bore 32.

In some embodiments, an outer barrier layer 28 may be disposed directly over the depicted intermediate layer 34 and, thus, cover and/or define (e.g., enclose) the depicted fluid conduit 24. However, in other embodiments, the tubing annulus 25 of pipe segment tubing 22 may include multiple (e.g., two, three, four, or more) intermediate layers 34. In other words, in such embodiments, one or more other intermediate layers 34 may be disposed over the depicted intermediate layer 34. In fact, in some such embodiments, the one or more other intermediate layers 34 may also each be helically disposed such that gaps are left between adjacent windings to implement one or more corresponding fluid conduits 24 in the pipe segment tubing 22.

For example, a first other intermediate layer 34 may be helically disposed on the depicted intermediate layer 34 using the same non-zero lay angle as the depicted intermediate layer 34 to cover (e.g., define and/or enclose) the depicted fluid conduit 24 and to implement another fluid conduit 24 in the first other intermediate layer 34. Additionally, a second other intermediate layer 34 may be helically disposed on the first other intermediate layer 34 using another non-zero lay angle, which is the inverse of the non-zero lay angle of the depicted intermediate layer 34, to implement another fluid conduit 24 in the second other intermediate layer 34. Furthermore, a third other intermediate layer 34 may be helically disposed on the second other intermediate layer 34 using the same non-zero lay angle as the second other intermediate layer 34 to cover the other fluid conduit 24 in the second other intermediate layer 34 and to implement another fluid conduit 24 in the third other intermediate layer 34. In some embodiments, an outer barrier layer 28 may be disposed over the third other intermediate layer 34 and, thus, cover (e.g., define and/or enclose) the other fluid conduit 24 in the third other intermediate layer 34. In any case, as described above, in some instances, one or more pipe segments 20 may be deployed in a pipeline system 10 via a pipe deployment system.

Figure 4:
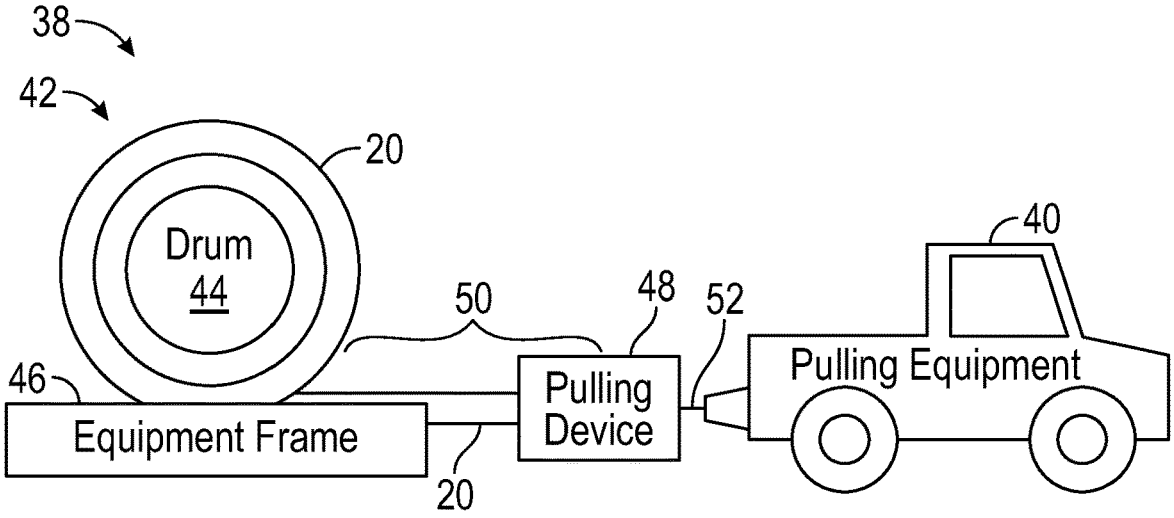
FIG. 4 is a side view of an example of a pipe deployment system that is loaded with a pipe segment spooled on a pipe drum, in accordance with an embodiment of the present disclosure.

To help illustrate, an example of a pipe deployment system 38 is shown in FIG. 4. As depicted, the pipe deployment system 38 includes pulling equipment 40 and pipe deployment equipment 42. In some embodiments, the pipe deployment equipment 42 may be a pipe deployment trailer or a pipe deployment cradle while the pulling equipment 40 may be a tow vehicle (e.g., truck), a bulldozer, an excavator, or the like.

Additionally, as depicted, a pipe drum 44 and a pipe segment 20 spooled (e.g., wrapped and/or wound) thereon are loaded on an equipment frame 46 of the pipe deployment equipment 42. Furthermore, in the depicted example, the pipe deployment system 38 additionally includes a pulling device (e.g., sledge) 48. In particular, in the depicted example, the pulling device 48 is secured to a free (e.g., unspooled) section 50 of the pipe segment 20 as well as being secured to the pulling equipment 40 via one or more pulling cables 52. In this manner, the pulling equipment 40 may exert pulling force on the pulling device 48 and, thus, the pipe segment 20 to facilitate unspooling more of the pipe segment 20 off of the pipe drum 44.

However, it should be appreciated that the depicted example is merely intended to be illustrative and not limiting. In particular, in other embodiments, pulling equipment 40 in a pipe deployment system 38 may be secured to pipe deployment equipment 42 in the pipe deployment system 38 via one or more pulling cables 52 and the pipe deployment equipment 42 may include wheels rotatably secured to its equipment frame 46 to enable the pulling equipment 40 to tow (e.g., pull) the pipe deployment equipment. Thus, in such embodiments, a pipe segment 20, which is spooled on a pipe drum 44 loaded on the pipe deployment equipment 42, may be deployed at least in part by securing a free end of the pipe segment 20 in place and towing the pipe deployment equipment 42 away from the free end of the pipe segment 20 via the pulling equipment 40. In any case, in this manner, a pipe deployment system 38 may exert pulling force on a pipe segment 20, which is spooled on a pipe drum 44, to facilitate unspooling more of the pipe segment 20 off of the pipe drum 44.

Figure 5:
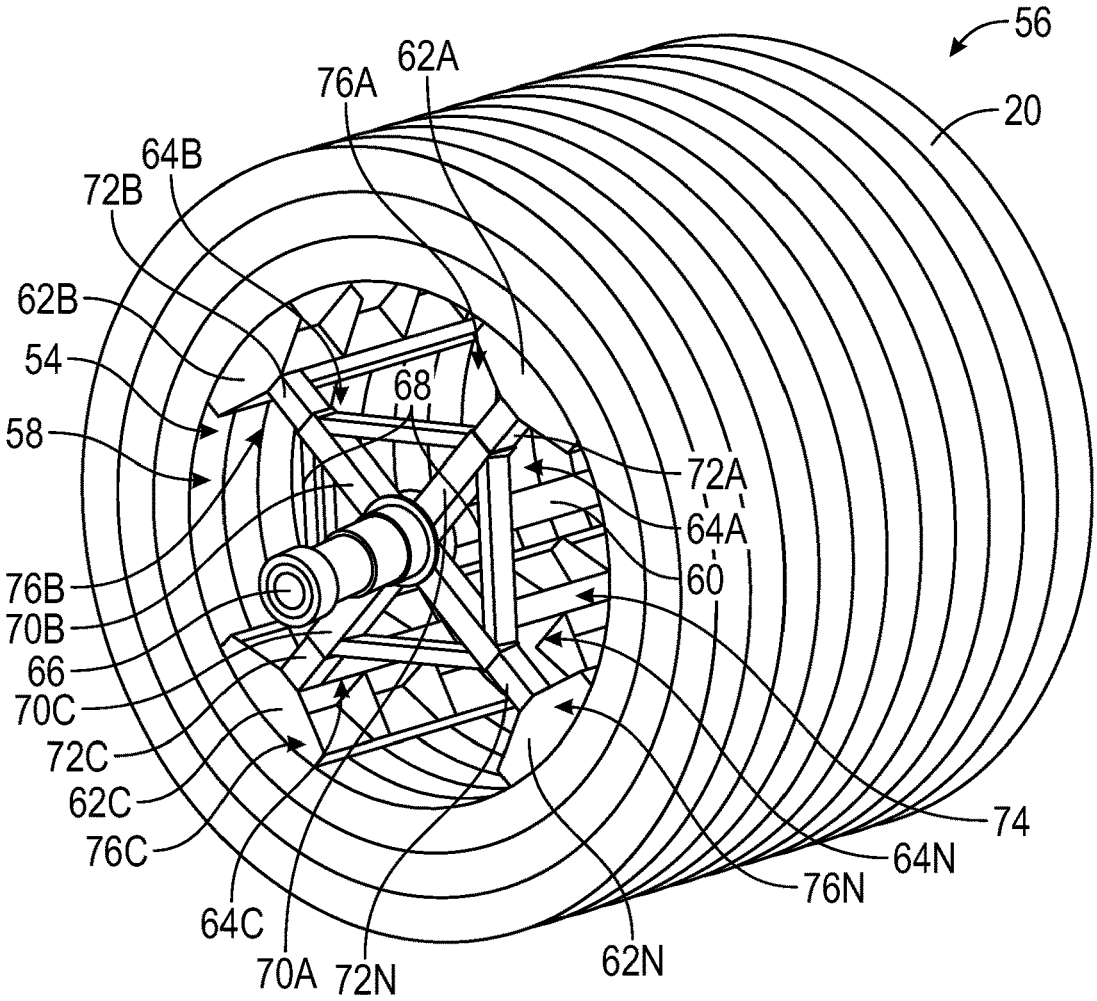
FIG. 5 is a perspective view of an example of a pipe coil spooled on a pipe drum, in accordance with an embodiment of the present disclosure.

To help further illustrate, an example of a drum body 54, which may be included in a pipe drum 44, is shown in FIG. 5. As depicted, a pipe segment 20, which is formed into a pipe coil 56 that includes an interior channel 58, is disposed on (e.g., around) the drum body 54. In some embodiments, a pipe coil 56 may be formed at least in part by spooling (e.g., wrapping and/or winding) a pipe segment 20 onto the drum body 54 of a pipe drum 44, for example, using spooling equipment. However, as will be described in more detail below, in some embodiments, the drum body 54 of a pipe drum 44 may be disposed within the interior channel 58 of a pipe coil 56 after the pipe coil 56 is formed.

In any case, as depicted, the drum body 54 includes an axial support bar 60, drum paddles 62, and expandable body spokes 64, for example, in addition to drum shafts 66 that extend out from the axial support bar 60 and/or circumferential support bars 68 secured between adjacent expandable body spokes 64. In particular, as depicted, the outer surfaces of the drum paddles 62 define the outer surface diameter of the drum body 54. Additionally, to enable adaptively adjusting the outer surface diameter of the drum body 54, each drum paddle 62 is secured to the axial support bar 60 via one or more expandable body spokes 64. In particular, as depicted, each expandable body spoke 64 includes a female section 70, which is secured to the axial support bar 60, and a male section 72, which is implemented to move telescopically within a corresponding female section 70 and secured to an inner surface of a corresponding drum paddle 62.

Thus, in some embodiments, a drum body 54 of a pipe drum 44 may actually be implemented as a drum core 74 and paddle assemblies 76, which are each slidably coupled to the drum core 74. In particular, the drum core 74 may include the axial support bar 60, a first female section 70A of a first expandable body spoke 64A, a second female section 70B of a second expandable body spoke 64B, a third female section 70C of a third expandable body spoke 64C, and an Nth female section of an Nth expandable body spoke 64N, for example, in addition to drum shafts 66 that expend out from the axial support bar 60 and/or circumferential support bars 68 secured between female sections 70 of adjacent expandable body spokes 64. Although obfuscated from view, the opposite side of the drum core 74 may additionally include an N+1th female section 70 of an N+1th expandable body spoke 64, which is parallel to the first expandable body spoke 64A, an N+2th female section 70 of an N+2th expandable body spoke 64, which is parallel to the second expandable body spoke 64B, an N+3th female section 70 of an N+3th expandable body spoke 64, which is parallel to the third expandable body spoke 64C, and a 2Nth female section 70 of an 2Nth expandable body spoke 64, which is parallel to the Nth expandable body spoke 64N.

On the other hand, in such embodiments, each paddle assembly 76 of the drum body 54 may include a drum paddle 62 and the male sections 72 of one or more expandable body spokes 64 that are secured to the inner surface of the drum paddle 62. For example, a first paddle assembly 76A may include a first drum paddle 62A, a first male section 72A of the first expandable body spoke 64A, and an N+1th male section 72 of the N+1th expandable body spoke 64 while an Nth paddle assembly 76N may include an Nth drum paddle 62N, an Nth male section 72N of the Nth expandable body spoke 64N, and a 2Nth male section 72 of the 2Nth expandable body spoke 64. Similarly, a second paddle assembly 76B may include a second drum paddle 62B, a second male section 72B of the second expandable body spoke 64B, and an N+2th male section 72 of the N+2th expandable body spoke 64 while a third paddle assembly 76C may include a third drum paddle 62C, a third male section 72C of the third expandable body spoke 64C, and an N+3th male section 72 of the N+3th expandable body spoke 64.

However, it should be appreciated that the depicted example is merely intended to be illustrative and not limiting. In particular, in other embodiments, the orientation of the male section 72 and the female section 70 in an expandable body spoke 64 of a drum body 54 may be reversed. In other words, in such embodiments, the drum core 74 of the drum body 54 may include the male section 72 of the expandable body spoke 64 while a paddle assembly 76 of the drum body 54 includes the female section 70 of the expandable body spoke 64.

In any case, implementing the drum body 54 using expandable body spokes 64 may enable its outer surface diameter to be adaptively (e.g., dynamically) adjusted. In particular, retracting a paddle assembly 76 such that its drum paddle 62 moves toward the axial support bar 60 may reduce the outer surface diameter of the drum body 54, for example, to facilitate disengaging the drum body 54 from the pipe coil 56 and, thus, withdrawing the drum body 54 from the pipe coil 56. On the other hand, extending a paddle assembly 76 such that its drum paddle 62 moves away from the axial support bar 60 may increase the outer surface diameter of the drum body 54, for example, such that the outer surface of the drum paddle 62 engages an inner surface of the pipe coil 56 and, thus, facilitates securing the drum body 54 within the interior channel 58 of the pipe coil 56.

However, it should again be appreciated that the depicted example is merely intended to be illustrative and not limiting. In particular, in other embodiments, a drum body 54 of a pipe drum 44 may include fewer than four (e.g., two or three) drum paddles 62 and, thus, fewer than eight (e.g., six, four, three, or two) expandable body spokes 64 or more than eight (e.g., five, six, or more) drum paddles 62 and, thus, more than eight (e.g., ten, twelve, or more) expandable body spokes 64. Additionally or alternatively, in other embodiments, a drum body 54 of a pipe drum 44 may not include drum shafts 66 and/or circumferential support bars 68. Furthermore, as will be described in more detail below, in some embodiments, a pipe drum 44 may additionally include drum flanges, which are implemented to be secured to its drum body 54 to facilitate retaining a pipe coil 56 on the drum body 54. Moreover, although a full pipe coil 56 is depicted, in other instances, a partial pipe coil 56 that has had one or more pipe wraps removed may be disposed on the drum body 54 of a pipe drum 44. In any case, to facilitate moving paddle assemblies 76 and, thus, corresponding drum paddles 62 of a drum body 54, the drum body 54 may additionally include one or more actuators.

Figure 6:
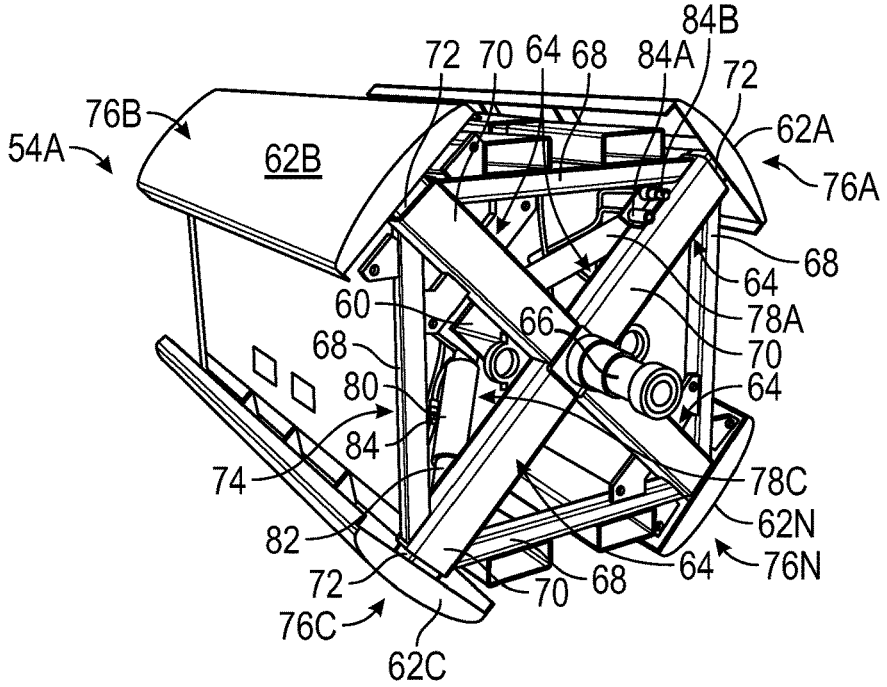
FIG. 6 is a perspective view of an example of the pipe drum of FIG. 5, in accordance with an embodiment of the present disclosure.

To help illustrate, a more detailed example of a drum body 54A is shown in FIG. 6. Similar to FIG. 5, as depicted in FIG. 6, the drum core 74 of the drum body 54A includes an axial support bar 60 and the female sections 70 of multiple expandable body spokes 64, for example, in addition to drum shafts 66 that extend out from the axial support bar 60 and/or circumferential support bars 68 secured between adjacent expandable body spokes 64. Additionally, similar to FIG. 5, as depicted in FIG. 6, the drum body 54A includes a first paddle assembly 76A, a second paddle assembly 76B, a third paddle assembly 76C, and an Nth paddle assembly 76N, which each includes a drum paddle 62 and male sections 72 of the expandable body spokes 64 that are secured to an inner surface of the drum paddle 62. In fact, in some embodiments, the drum core 74 of FIG. 6 may generally match the drum core 74 of FIG. 5 and/or the paddle assemblies 76 of FIG. 6 may generally match the paddle assemblies 76 of FIG. 5.

However, as depicted in FIG. 6, the drum body 54A additionally includes actuators 78, which are each secured between the drum core 74 and a corresponding paddle assembly 76. In particular, in the depicted example, a first actuator 78A is secured between the axial support bar 60 and the inner surface of a first drum paddle 62A in the first paddle assembly 76A. Although obfuscated from view, a second actuator 78 is similarly secured between the axial support bar 60 and the inner surface of a second drum paddle 62B in the second paddle assembly 76B. Furthermore, in the depicted example, a third actuator 78C is secured between the axial support bar 60 and the inner surface of a third drum paddle 62C in the third paddle assembly 76C. Similarly, although obfuscated from view, an Nth actuator 78 is secured between the axial support bar 60 and the inner surface of an Nth drum paddle 62N in the Nth paddle assembly 76N.

To facilitate moving the paddle assemblies 76, in some embodiments, the drum body 54A may include other actuators 78 in addition to the depicted actuators 78. In particular, in some such embodiments, the drum body 54A may additionally include an N+1th actuator 78, which is secured between an opposite side of the axial support bar 60 and the first drum paddle 62A of the first paddle assembly 76A, and a 2Nth actuator 78, which is secured between the opposite side of the axial support bar 60 and the Nth drum paddle 62N of the Nth paddle assembly 76. Additionally, the drum body 54A may include an N+2th actuator 78, which is secured between the opposite side of the axial support bar 60 and the second drum paddle 62B of the second paddle assembly 76B, and an N+3th actuator 78, which is secured between the opposite side of the axial support bar 60 and the third drum paddle 62C of the third paddle assembly 76C. In any case, in this manner, a drum body 54 of a pipe drum 44 in a pipe deployment system 38 may be implemented to enable the outer surface diameter of the drum body 54 to be adaptively (e.g., dynamically) adjusted, which, at least in some instances, may facilitate reducing implementation-associated cost (e.g., component count and/or physical footprint) of the pipe deployment system 38, for example, at least in part by enabling the same pipe drum 44 to be used with multiple different pipe coils 56.

However, it should be appreciated that the depicted example is merely intended to be illustrative and not limiting. In particular, in other embodiments, the drum body 54 of a pipe drum 44 may include more than eight (e.g., nine, ten, or more) actuators 78 or less than eight (e.g., seven, six, or fewer) actuators 78. Additionally or alternatively, the drum body 54 of a pipe drum 44 may include more than two (e.g., three, four, or more) actuators 78 per paddle assembly 76 or fewer than two (e.g., one) actuators 78 per paddle assembly 76. Furthermore, as will be described in more detail below, in other embodiments, an actuator 78 in a drum body 54 may not be secured directly to a corresponding paddle assembly 76 of the drum body 54, for example, instead being connected to the paddle assembly 76 via a slidable ring disposed around the axial support bar 60 and a pivoting member connected between the slidable ring and the paddle assembly 76.

In any case, in some embodiments, the actuators 78 included in the drum body 54 of a pipe drum 44 may each be a fluid actuator 78. For example, a fluid actuator 78 in the drum body 54 may be a pneumatic actuator 78 or a hydraulic actuator 78, which includes an actuator cylinder 80 and an actuator piston 82. In particular, as in the depicted example, in some embodiments, the actuator cylinder 80 of an actuator 78 in the drum body 54 of a pipe drum 44 may be secured to the axial support bar 60 in the drum body 54 while the actuator piston 82 of the actuator 78 may be secured to the inner surface of a corresponding drum paddle 62 in the drum body 54.

However, it should be appreciated that the depicted example is merely intended to be illustrative and not limiting. In particular, in other embodiments, the orientation of an actuator 78 in the drum body 54 of a pipe drum 44 may be reversed. In other words, in such embodiments, the actuator cylinder 80 of the actuator 78 may be secured to the inner surface of a corresponding drum paddle 62 in the drum body 54 while the actuator piston 82 of the actuator 78 may be secured to the axial support bar 60 in the drum body 54.

In any case, to facilitate enable actuation fluid to be selectively supplied thereto, as depicted, each fluid actuator 78 in the drum body 54A includes one or more fluid ports 84. In particular, a fluid actuator 78 may include a cylinder-side fluid port 84A, which enables actuation fluid to flow into and/or out from the cylinder-side of the fluid actuator 78. As in the depicted example, in some embodiments, a fluid actuator 78 may additionally include a piston-side fluid port 84B, which enables actuation fluid to flow into and/or out from the piston-side of the fluid actuator 78.

However, it should again be appreciated that the depicted example is merely intended to be illustrative and not limiting. In particular, as will be described in more detail below, in other embodiments, a fluid actuator 78 of a drum body 54 may include a fluid bladder, for example, instead of an actuator cylinder 80 and an actuator piston 82. Additionally or alternatively, a fluid actuator 78 in a drum body 54 may include a single fluid port 84, for example, a cylinder-side fluid port 84A or a bladder fluid port 84. In any case, to facilitate powering (e.g., driving) operation of fluid actuators 78 in a drum body 54 of a pipe drum 44, a pipe deployment system 38 may include a fluid power sub-system.

Figure 7:
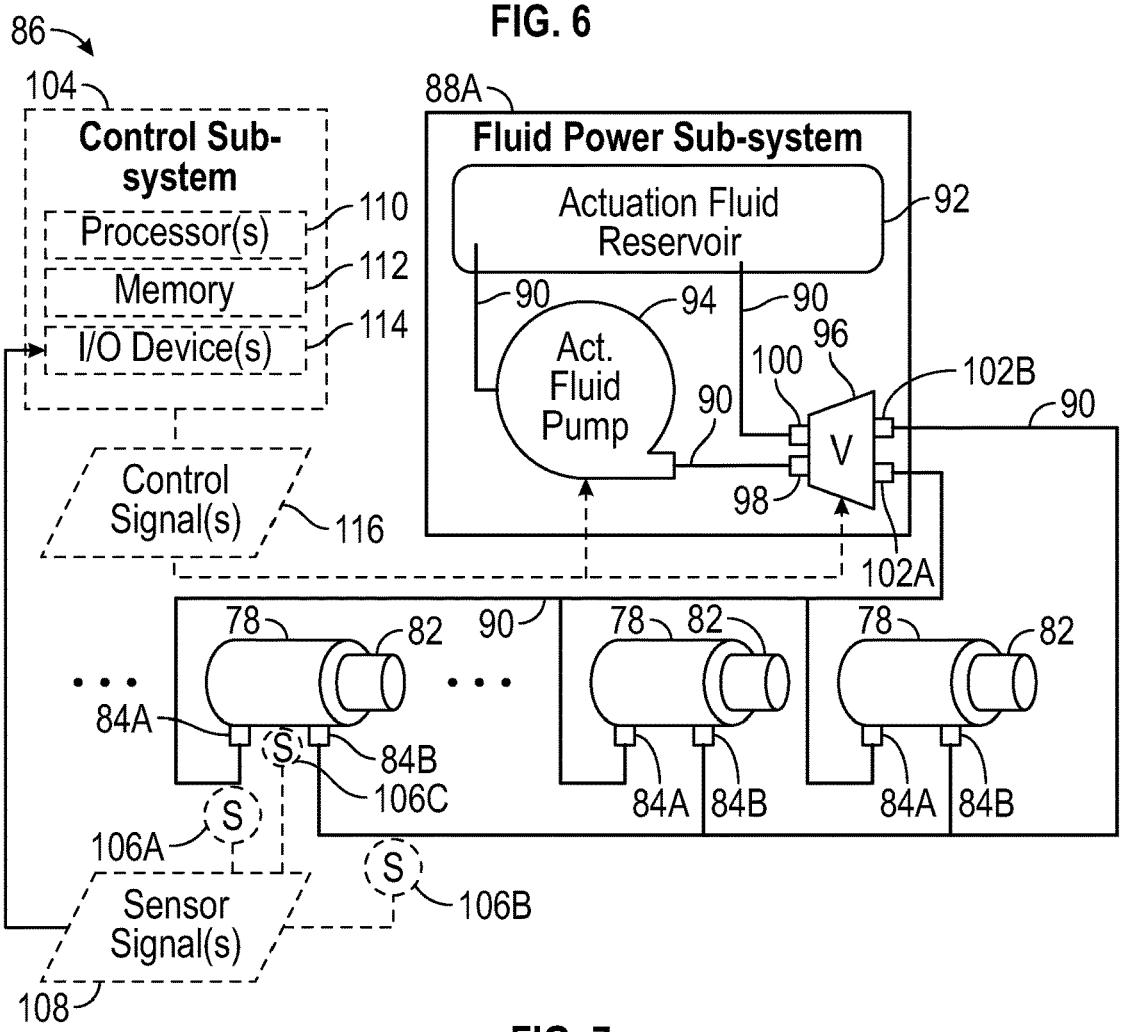
FIG. 7 is a block diagram of an example of a portion of a pipe deployment system that includes a fluid power sub-system, in accordance with an embodiment of the present disclosure.

To help illustrate, an example of a portion 86 of a pipe deployment system 38, which includes a fluid power sub-system 88A and fluid actuators 78 of a drum body 54, is shown in FIG. 7. As depicted, each fluid actuator 78 includes a cylinder-side fluid port 84A and a piston-side fluid port 84B. In particular, in the depicted example, each fluid port 84 of the fluid actuators 78 is fluidly connected to the fluid power sub-system 88A via one or more external fluid conduits 90, such as a hose.

Additionally, in the depicted example, the fluid power sub-system 88A includes an actuation fluid reservoir 92, an actuation fluid pump 94, and an actuation fluid valve 96. In particular, the actuation fluid reservoir 92 may be implemented to store actuation fluid that will be used to power (e.g., drive) operation of the fluid actuators 78 in the drum body 54. Additionally, as depicted, the actuation fluid pump 94 is fluidly connected to the actuation fluid reservoir 92 via one or more external fluid conduits 90, such as a hose.

Furthermore, in the depicted example, the actuation fluid valve 96 includes four fluid ports—namely an inlet fluid port 98, a flowback fluid outlet port 100, a first switchable fluid port 102A, and a second switchable fluid port 102B. In particular, as depicted, the inlet fluid port 98 is fluidly connected to the actuation fluid pump 94 via one or more external fluid conduits 90, such as a hose, while the flowback fluid outlet port 100 is fluidly connected to the actuation fluid reservoir 92 via one or more external fluid conduits 90, such as a hose. Additionally, as depicted, the first switchable fluid port 102A is fluidly connected to the cylinder-side fluid port 84A of each fluid actuator 78 via one or more external fluid conduits 90, such as a hose, while the second switchable fluid port 102B is fluidly connected to the piston-side fluid port 84B of each fluid actuator 78 via one or more external fluid conduits 90, such as a hose.

Generally, the actuation fluid valve 96 may operate to selectively connect its inlet fluid port 98 to one of the first switchable fluid port 102A and the second switchable fluid port 102B while connecting the other of the first switchable fluid port 102A and the second switchable fluid port 102B to the flowback fluid outlet port 100. For example, to facilitate extending the fluid actuators 78, the actuation fluid valve 96 may be operated to connect its inlet fluid port 98 to the first switchable fluid port 102A, which is fluidly connected to the cylinder-side fluid ports 84A of the fluid actuators 78, and to connect its flowback fluid outlet port 100 to the second switchable fluid port 102B, which is fluidly connected to the piston-side fluid ports 84B of the fluid actuators 78. On the other hand, to facilitate retracting the fluid actuators 78, the actuation fluid valve 96 may be operated to connect its inlet fluid port 98 to the second switchable fluid port 102B, which is fluidly connected to the piston-side fluid ports 84B of the fluid actuators 78, and to connect its flowback fluid outlet port 100 to the first switchable fluid port 102A, which is fluidly connected to the cylinder-side fluid ports 84A of the fluid actuators 78.

To facilitate controlling operation of its fluid power sub-system 88, as in the depicted example, in some embodiments, a pipe deployment system 38 may additionally include a control sub-system 104. In fact, in some embodiments, the control sub-system 104 may be implemented and/or operated to autonomously control operation of the pipe deployment system 38, for example, with little or no user intervention. In any case, to facilitate controlling operation, as in the depicted example, in some embodiments, the control sub-system 104 may be communicatively coupled to one or more sensors 106.

Generally, a sensor 106 in a pipe deployment system 38 may be implemented and/or operated to determine sensor data indicative of one or more operational parameters of the pipe deployment system 38, which may be communicated to a control sub-system 104 in the pipe deployment system 38 via one or more sensor signals 108. For example, a cylinder-side pressure sensor 106A may determine sensor data indicative of fluid pressure being supplied to the cylinder-side fluid ports 84A of the fluid actuators 78. As another example, a piston-side pressure sensor 106B may determine sensor data indicative of fluid pressure being supplied to the piston-side fluid ports 84B of the fluid actuators 78. As a further example, a position sensor 106C may determine sensor data indicative of the position of an actuator piston 82 (e.g., extension state) in a corresponding fluid actuator 78.

In any case, to facilitate controlling operation of the pipe deployment system 38, as in the depicted example, the control sub-system 104 may include one or more processors 110, memory 112, and one or more input/output (I/O) devices 114. In some embodiments, the memory 112 in the control sub-system 104 may include one or more tangible, non-transitory, computer-readable media that are implemented and/or operated to store data and/or executable instructions. For example, the memory 112 may store sensor data based at least in part on one or more sensor signals 108 received from a sensor 106. As such, in some embodiments, the memory 112 may include volatile memory, such as random-access memory (RAM), and/or non-volatile memory, such as read-only memory (ROM), flash memory, a solid-state drive (SSD), a hard disc drive (HDD), or any combination thereof.

Additionally, in some embodiments, a processor 110 in the control sub-system 104 may include processing circuitry that is implemented and/or operated to process data and/or to execute instructions stored in memory 112. In other words, in some such embodiments, a processor 110 in the control sub-system 104 may include one or more general purpose microprocessors, one or more application specific integrated circuits (ASICs), one or more field programmable gate arrays (FPGAs), or any combination thereof. For example, a processor 110 in the control sub-system 104 may process sensor data that is determined by a position sensor 106C to determine the extension state of a corresponding fluid actuator 78 and, thus, a corresponding paddle assembly 76.

Additionally or alternatively, a processor 110 in the control sub-system 104 may execute instructions stored in memory 112 to determine one or more control (e.g., command) signals 116 that instruct the pipe deployment system 38 to perform corresponding control actions. For example, the control sub-system 104 may determine a control signal 116 that instructs the actuation fluid pump 94 to flow actuation fluid from the actuation fluid reservoir 92 to the inlet fluid port 98 of the actuation fluid valve 96. As another example, the control sub-system 104 may determine a control signal 116 that instructs the actuation fluid valve 96 to connect its inlet fluid port 98 to the first switchable fluid port 102A and to connect its flowback fluid outlet port 100 to the second switchable fluid port 102B or vice versa.

To enable communication outside of the control sub-system 104, in some embodiments, the I/O devices 114 of the control sub-system 104 may include one or more input/output (I/O) ports (e.g., terminals). Additionally, to facilitate communicating operational status of a pipe deployment system 38 to a user (e.g., operator or service technician), in some embodiments, the I/O devices 114 of the control sub-system 104 may include one or more user output devices, such as an electronic display, which is implemented and/or operated to display a graphical user interface (GUI) that provides a visual representation of one or more operational parameters of the pipe deployment system 38. Furthermore, to enable user interaction with a pipe deployment system 38, in some embodiments, the I/O devices 114 of the control sub-system 104 may include one or more user input devices, such as a hard button, a soft button, a keyboard, a mouse, and/or the like. In any case, in this manner, a pipe deployment system 38 may be implemented to enable the fluid actuators 78 and, thus, the paddle assemblies 76 of a drum body 54 to be moved concurrently.

However, it should be appreciated that the depicted example is merely intended to be illustrative and not limiting. In particular, in other embodiments, a pipe deployment system 38 may not include a control sub-system 104 and/or a sensor 106, for example, when operation of the pipe deployment system 38 is to be manually controlled. Additionally or alternatively, in other embodiments, a fluid power sub-system 88 in a pipe deployment system 38 may be implemented and/or operated to enable different fluid actuators 78 and, thus, different paddle assemblies 76 of a drum body 54 to move independently, which, as will be described in more detail below, may facilitate securing drum flanges to the drum body 54 and/or loading a pipe coil 56 on pipe deployment equipment 42.

Figure 8:
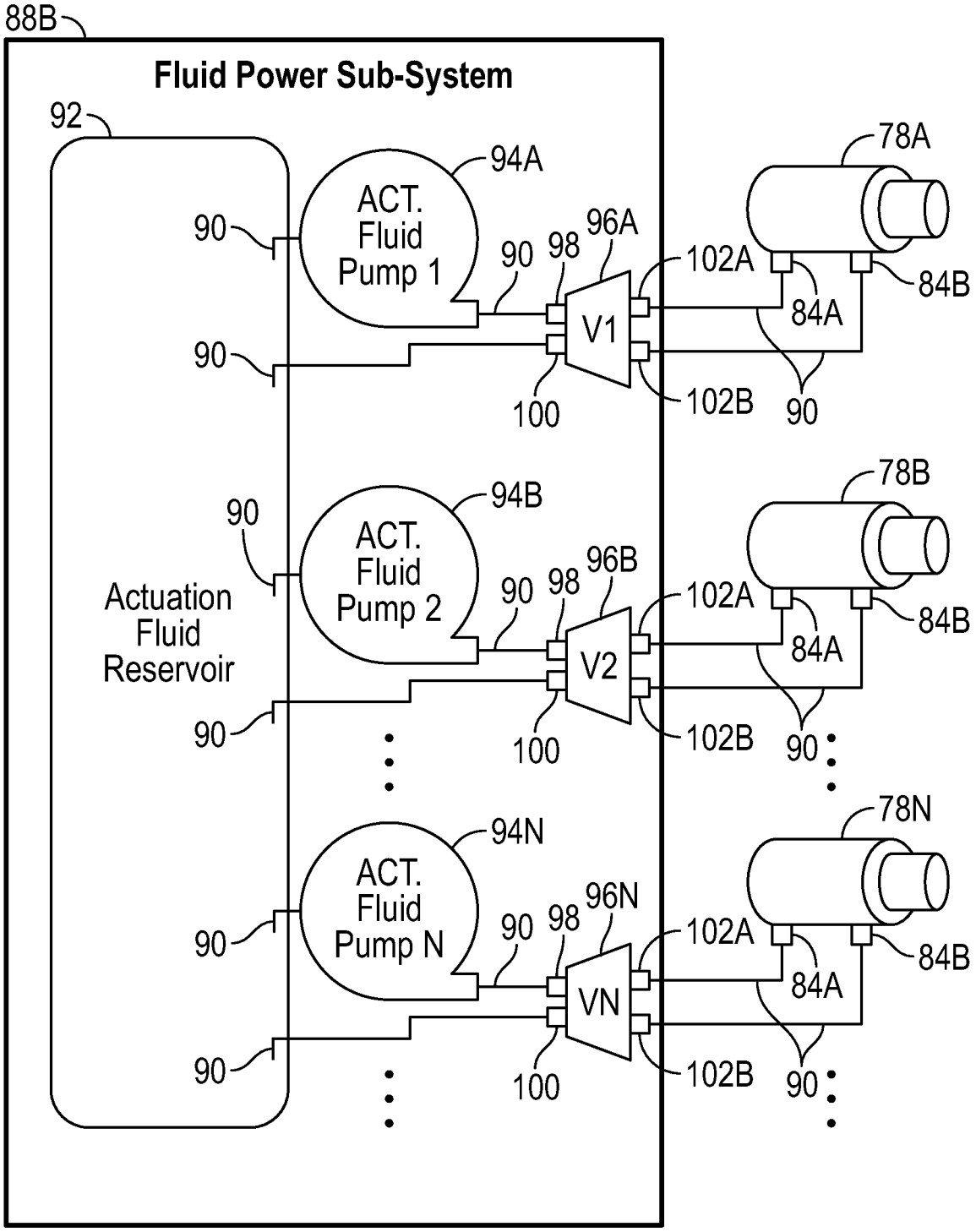
FIG. 8 is a block diagram of another example of a fluid power sub-system in a pipe deployment system that includes dedicated actuation fluid pumps and dedicated actuation fluid valves, in accordance with an embodiment of the present disclosure.

To help illustrate, another example of a fluid power sub-system 88B, which may be included in a pipe deployment system 38, is shown in FIG. 8. Similar to FIG. 7, as depicted in FIG. 8, the fluid power sub-system 88B is fluidly coupled to the fluid actuators 78 in a drum body 54 of a pipe drum 44 via one or more external fluid conduits 90, such as a hose. Additionally, similar to FIG. 7, as depicted in FIG. 8, the fluid power sub-system 88B includes an actuation fluid reservoir 92, which is implemented to store actuation fluid that will be used to power (e.g., drive) operation of the fluid actuators 78.

However, as depicted in FIG. 8, the fluid power sub-system 88B includes multiple actuation fluid pumps 94 and multiple actuation fluid valves 96. In particular, in the depicted example, each actuation fluid pump 94 and each actuation fluid valve 96 is dedicated to a different fluid actuator 78. For example, a first actuation fluid pump 94A and a first actuation fluid valve 96A may be dedicated to a first fluid actuator 78A while a second actuation fluid pump 94B and a second actuation fluid valve 96B may be dedicated to a second fluid actuator 78B. Similarly, an Nth actuation fluid pump 94N and an Nth actuation fluid valve 96N may be dedicated to an Nth fluid actuator 78N.

Nevertheless, similar to FIG. 7, as depicted in FIG. 8, each actuation fluid pump 94 in the fluid power sub-system 88B is fluidly connected to the actuation fluid reservoir 92 via one or more external fluid conduits 90, such as a hose. Additionally, similar to FIG. 7, as depicted in FIG. 8, each actuation fluid valve 96 in the fluid power sub-system 88B includes four fluid ports—namely an inlet fluid port 98, a flowback fluid outlet port 100, a first switchable fluid port 102A, and a second switchable fluid port 102B. In particular, the inlet fluid port 98 of each actuation fluid valve 96 is fluidly connected to a corresponding actuation fluid pump 94 via one or more external fluid conduits 90, such as a hose, the flowback fluid outlet port 100 of each actuation fluid valve 96 is fluidly connected to the actuation fluid reservoir 92 via one or more external fluid conduits 90, such as a hose, the first switchable fluid port 102A of each actuation fluid valve 96 is fluidly connected to the cylinder-side fluid port 84A of a corresponding fluid actuator 78 via one or more external fluid conduits 90, such as a hose, and the second switchable fluid port 102B of each actuation fluid valve 96 is fluidly connected to the piston-side fluid port 84B of the corresponding fluid actuator 78 via one or more external fluid conduits 90, such as a hose.

Accordingly, implementing a fluid power sub-system 88 of a pipe deployment system 38 in this manner may enable different fluid actuators 78 and, thus, different paddle assemblies 76 of a pipe drum 44 in the pipe deployment system 38 to be moved independently, for example, at different times and/or in different manners. Merely as an illustrative non-limiting example, the fluid power sub-system 88B may be operated to cause the first fluid actuator 78A and, thus, a first paddle assembly 76A corresponding with the first fluid actuator 78A to extend while concurrently causing the Nth fluid actuator 78N and, thus, an Nth paddle assembly 76N corresponding with the Nth fluid actuator 78N to retract. Additionally or alternatively, the fluid power sub-system 88B may be operated to cause the Nth fluid actuator 78N and, thus, an Nth paddle assembly 76N corresponding with the Nth fluid actuator 78N to move (e.g., extend and/or retract) while the first fluid actuator 78A and, thus, a first paddle assembly 76 corresponding with the first fluid actuator 78A is maintained in its current extension state. In any case, in this manner, a fluid power sub-system 88 may be implemented to enable the fluid actuators 78 and, thus, the paddle assemblies 76 of a pipe drum 44 to be moved independently, which, as will be described in more detail below, may facilitate securing drum flanges to the drum body 54 of the pipe drum 44 and/or loading a pipe coil 56 on pipe deployment equipment 42.

However, it should be appreciated that the depicted example is merely intended to be illustrative and not limiting. In particular, in other embodiments, the fluid power sub-system 88B may include fewer than three (e.g., two) actuation fluid pumps 94 and fewer than three (e.g., two) actuation fluid valves 96, for example, when a corresponding pipe drum 44 includes fewer than three fluid actuators 78. Alternatively, in other embodiments, the fluid power sub-system 88B may include more than three (e.g., four, five, or more) actuation fluid pumps 94 and more than three (e.g., four, five, or more) actuation fluid valves 96, for example, when a corresponding pipe drum 44 includes more than three fluid actuators 78. Moreover, to facilitate reducing implementation-associated cost (e.g., component count and/or physical footprint), in other embodiments, a fluid power sub-system 88 may be implemented with a single actuation fluid pump 94 and a single actuation fluid valve 96 while still enabling different paddle assemblies 76 of a drum body 54 to be moved independently, for example, at different times and/or in different manners.

Figure 9:
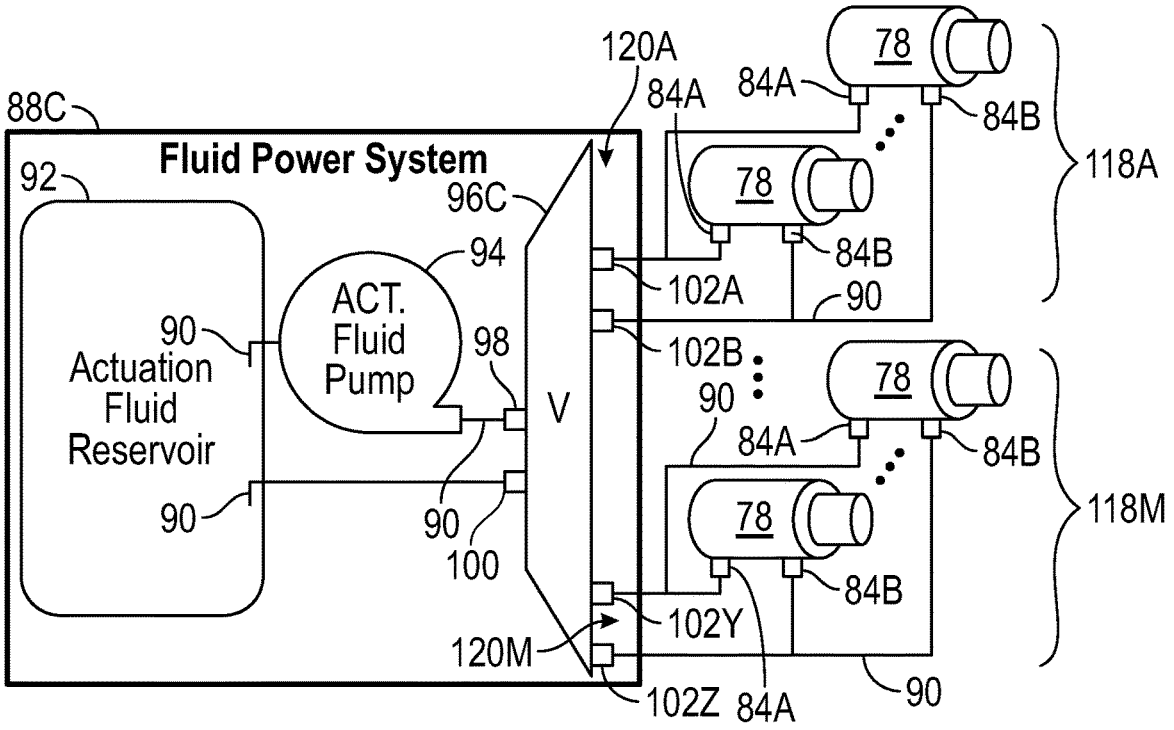
FIG. 9 is a block diagram of another example of a fluid power sub-system in a pipe deployment system that includes a single actuation fluid pump and a single actuation fluid valve, in accordance with an embodiment of the present disclosure.

To help illustrate, another example of a fluid power sub-system 88C, which may be included in a pipe deployment system 38, is shown in FIG. 9. Similar to FIG. 7, as depicted in FIG. 9, the fluid power sub-system 88C is fluidly connected to the fluid actuators 78 in a drum body 54 of a pipe drum 44 via one or more external fluid conduits 90, such as a hose. Additionally, similar to FIG. 7, as depicted in FIG. 9, the fluid power sub-system 88C includes a fluid reservoir 92, an actuation fluid pump 94, which is fluidly connected to the actuation fluid reservoir 92 via one or more external fluid conduits 90, such as a hose, and an actuation fluid valve 96C. In particular, similar to FIG. 7, as depicted in FIG. 9, the actuation fluid valve 96C includes an inlet fluid port 98, which is fluidly connected to the actuation fluid pump 94 via one or more external fluid conduits 90, such as a hose, and a flowback fluid outlet port 100, which is fluidly connected to the actuation fluid reservoir 92 via one or more external fluid conduits 90, such as a hose.

However, as depicted in FIG. 9, the actuation fluid valve 96 in the fluid power sub-system 88C includes more than two switchable fluid ports 102. In particular, in the depicted example, pairs of switchable fluid ports 102 are each dedicated to a different actuator set 118, which includes multiple fluid actuators 78. For example, a first switchable fluid port pair 120A may include a first switchable fluid port 102A that is fluidly connected to the cylinder-side fluid port 84A of each fluid actuator 78 in a first actuator set 118A via one or more external fluid conduits 90, such as a hose, and a second switchable fluid port 102B that is fluidly connected to the to the piston-side fluid port 84B of each fluid actuator 78 in the first actuator set 118A via one or more external fluid conduits 90, such as a hose, and, thus, dedicated to the first actuator set 118A. Similarly, an Mth switchable fluid port pair 120M may include a 2Mth switchable fluid port 102Y that is fluidly connected to the cylinder-side fluid port 84A of each fluid actuator 78 in an Mth actuator set 118M via one or more external fluid conduits 90, such as a hose, and a 2M+1th switchable fluid port 102Z that is fluidly connected to the piston-side fluid port 84B of each fluid actuator 78 in the Mth actuator set 118M via one or more external fluid conduits 90, such as a hose, and, thus, dedicated to the Mth actuator set 118M.

Generally, the actuation fluid valve 96C of FIG. 9 may be operated to selectively connect its inlet fluid port 98 to one switchable fluid port 102 in a switchable fluid port pair 120 while connecting its flowback fluid outlet port 100 to the other switchable fluid port 102 in the switchable fluid port pair 120. For example, during a first time period, the actuation fluid valve 96C may be operated to connect its inlet fluid port 98 to the first switchable fluid port 102A, which is fluidly connected to the cylinder-side fluid ports 84A of the fluid actuators 78 in the first actuator set 118A, and its flowback fluid outlet port 100 to the second switchable fluid port 102B, which is fluidly connected to the piston-side fluid ports 84B of the fluid actuators 78 in the first actuator set 118A, or vice versa. Additionally, during a second (e.g., different, previous, or subsequent) time period, the actuation fluid valve 96C may be operated to connect its inlet fluid port 98 to the 2Mth switchable fluid port 102Y, which is fluidly connected to the cylinder-side fluid ports 84A of the fluid actuators 78 in the Mth actuator set 118M, and its flowback fluid outlet port 100 to the 2M+1th switchable fluid port 102Z, which is fluidly connected to the piston-side fluid ports 84B of the fluid actuators 78 in the Mth actuator set 118M.

In other words, implementing a fluid power sub-system 88 of a pipe deployment system 38 in this manner may enable fluid actuators 78 in different actuator sets 118 to be moved (e.g., extended and/or retracted) independently (e.g., at different times and/or in different manners) while enabling each fluid actuator 78 in the same actuator set 118 to be move concurrently in the same manner. Thus, to enable each paddle assembly 76 of a pipe drum 44 to be moved independently, in some embodiments, the fluid actuators 78 may be grouped into actuator sets 118 such that each actuator set 118 includes the fluid actuators 78 associated with a corresponding paddle assembly 76. For example, the first actuator set 118A may correspond with a first paddle assembly 76A and, thus, include a first fluid actuator 78A and an N+1th fluid actuator 78, which are secured to the first paddle assembly 76A. Similarly, the Mth actuator set 118M may correspond with an Nth paddle assembly 76N and, thus, include an Nth fluid actuator 78N and a 2Nth fluid actuator 78, which are secured to the Nth paddle assembly 76N.

Although different paddle assemblies 76 of a pipe drum 44 may be moved independently, as will be described in more detail below, in some embodiments, the paddle assemblies 76 of the pipe drum 44 may nevertheless be grouped into paddle assembly sets in which each paddle assembly 76 in a paddle assembly set moves (e.g., extends and/or retracts) concurrently in the same manner. For example, a first paddle assembly 76A and a second paddle assembly 76B may be included in a first (e.g., upper) paddle assembly set while a third paddle assembly 76C and an Nth paddle assembly 76N may be included in a second (e.g., lower) paddle assembly set. Thus, in such embodiments, the fluid actuators 78 in the pipe drum 44 may be grouped into actuator sets 118 that each includes the fluid actuators 78 associated with a paddle assembly 76 in a corresponding paddle assembly set. In other words, continuing with the above example, the first actuator set 118A may correspond with the first paddle assembly set and, thus, include the first fluid actuator 78A and the N+1th fluid actuator 78, which are secured to the first paddle assembly 76A, as well as a second fluid actuator 78B and an N+2th fluid actuator, which are secured to the second paddle assembly 76B. Additionally, the Mth actuator set 118M may correspond with the second paddle assembly set and, thus, include the Nth fluid actuator 78N and the 2Nth fluid actuator 78, which are secured to the Nth paddle assembly 76N, as well as an third fluid actuator 78C and an N+3th fluid actuator 78, which are secured to the third paddle assembly 76C. In any case, in this manner, a fluid power sub-system 88 may be implemented to enable the fluid actuators 78 and, thus, the paddle assemblies 76 of a pipe drum 44 to be moved independently, which, as will be described in more detail below, may facilitate securing drum flanges to the drum body 54 of the pipe drum 44 and/or loading a pipe coil 56 on pipe deployment equipment 42.

However, it should be appreciated that the depicted example is merely intended to be illustrative and not limiting. In particular, in other embodiments, the actuation fluid valve 96C of FIG. 9 may include more than two (e.g., three, four, or more) switchable fluid port pairs 120, for example, when a corresponding pipe drum 44 includes more than two actuator sets 118. Additionally, in other embodiments, a fluid power sub-system 88 in a pipe deployment system 38 may be implemented and/or operated to enable different actuator sets 118 in a pipe drum 44 to be concurrently moved (e.g., extended and/or retracted) in opposite (e.g., different) manners.

Figure 10:
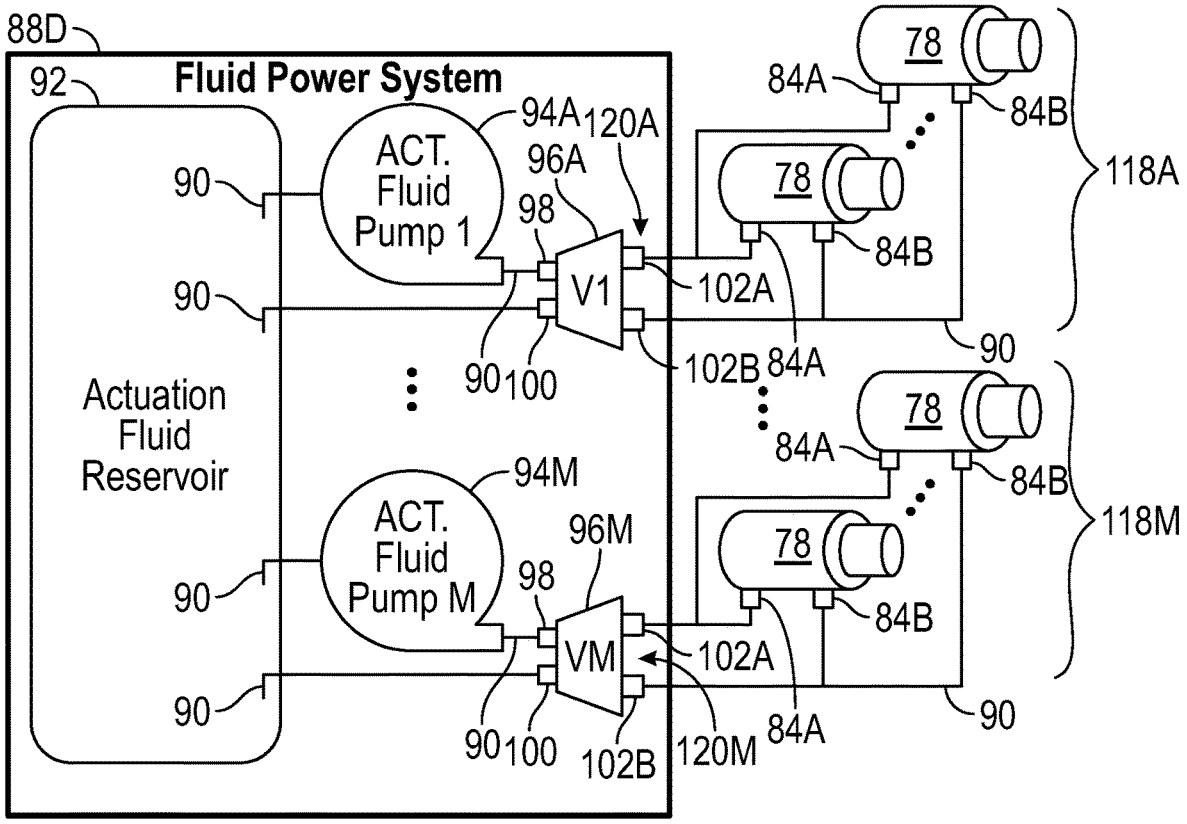
FIG. 10 is a block diagram of another example of a fluid power sub-system in a pipe deployment system that includes multiple actuation fluid pumps and multiple actuation fluid valves, in accordance with an embodiment of the present disclosure.

To help illustrate, another example of a fluid power sub-system 88D, which may be included in a pipe deployment system 38, is shown in FIG. 10. Similar to FIG. 8, as depicted in FIG. 10, the fluid power sub-system 88D is fluidly connected to a first actuator set 118A and an Mth actuator set 118M via one or more external fluid conduits 90, such as a hose. Additionally, similar to FIG. 8, as depicted in FIG. 10, the fluid power sub-system 88D includes an actuation fluid reservoir 92, multiple actuation fluid pumps 94 that are each fluidly connected to the actuation fluid reservoir 92 via one or more external fluid conduits 90, such as a hose, and multiple actuation fluid valves 96. Furthermore, similar to FIG. 9, as depicted in FIG. 10, the fluid power sub-system 88D include a first switchable fluid port pair 120A, which includes a first switchable fluid port 102A that is fluidly coupled to the cylinder-side fluid port 84A of each fluid actuator 78 in the first actuator set 118A via one or more external fluid conduits 90, such as a hose, and a second switchable fluid port 102B that is fluidly coupled to the piston-side fluid port 84B of each fluid actuator 78 in the first actuator set 118A via one or more external fluid conduits 90, such as a hose. Similarly, as depicted, the fluid power sub-system 88D includes an Mth switchable fluid port pair 120M, which includes a first switchable fluid port 102A that is fluidly coupled to the cylinder-side fluid port 84A of each fluid actuator 78 in the Mth actuator set 118M via one or more external fluid conduits 90, such as a hose, and a second switchable fluid port 102B that is fluidly coupled to the piston-side fluid port 84B of each fluid actuator 78 in the Mth actuator set 118M via one or more external fluid conduits 90, such as a hose.

However, as depicted in FIG. 10, each actuation fluid pump 94 and each actuation fluid valve 96 in the fluid power sub-system 88D is dedicated to a different actuator set 118. In particular, a first actuation fluid pump 94A and a first actuation fluid valve 96A are dedicated to the first actuator set 118A. Similarly, an Mth actuation fluid pump 94M and an Mth actuation fluid valve 96M are dedicated to the Mth actuator set 118M.

In any case, as described above, to enable each paddle assembly 76 of a pipe drum 44 to be moved independently, in some embodiments, the fluid actuators 78 of the pipe drum 44 may be grouped into actuator sets 118 such that each actuator set 118 includes the fluid actuators 78 associated with a corresponding paddle assembly 76. For example, the first actuator set 118A may correspond with a first paddle assembly 76A and, thus, include a first fluid actuator 78A and an N+1th fluid actuator 78, which are secured to the first paddle assembly 76A. Additionally, the Mth actuator set 118M may correspond with an Nth paddle assembly 76N and, thus, include an Nth fluid actuator 78N and a 2Nth fluid actuator 78, which are secured to the Nth paddle assembly 76N.

Although different paddle assemblies 76 of a pipe drum 44 may be moved independently, as will be described in more detail below, in some embodiments, the paddle assemblies 76 of the pipe drum 44 may nevertheless be grouped into paddle assembly sets in which each paddle assembly 76 in a paddle assembly set moves (e.g., extends and/or retracts) concurrently in the same manner. For example, a first paddle assembly 76A and a second paddle assembly 76B may be included in a first (e.g., upper) paddle assembly set while a third paddle assembly 76C and an Nth paddle assembly 76N may be included in a second (e.g., lower) paddle assembly set. Thus, in such embodiments, the fluid actuators 78 in the pipe drum 44 may be grouped into actuator sets 118 that each includes the fluid actuators 78 associated with a paddle assembly 76 in a corresponding paddle assembly set. In other words, continuing with the above example, the first actuator set 118A may correspond with the first paddle assembly set and, thus, include the first fluid actuator 78A and the N+1th fluid actuator 78, which are secured to the first paddle assembly 76A, as well as a second fluid actuator 78B and an N+2th fluid actuator, which are secured to the second paddle assembly 76B. Additionally, the Mth actuator set 118M may corresponding with the second paddle assembly set and, thus, include the Nth fluid actuator 78N and the 2Nth fluid actuator 78, which are secured to the Nth paddle assembly 76N, as well as an third fluid actuator 78C and an N+3th fluid actuator 78, which are secured to the third paddle assembly 76C.

In any case, since a different actuation fluid pump 94 and a different actuation fluid valve 96 are dedicated to each actuator set 118 in the pipe drum 44, the fluid power sub-system 88D may enable different actuator sets 118 to be concurrently moved independently. In fact, in some embodiments, the fluid power sub-system 88D may enable different actuators sets 118 to be concurrently moved in opposite manners. For example, the fluid power sub-system 88D may be operated to cause the fluid actuators 78 in the first actuator set 118A to extend while concurrently causing the fluid actuators 78 in the Mth actuator set 118M to retract or vice versa. In this manner, a fluid power sub-system 88 may be implemented to enable the fluid actuators 78 and, thus, the paddle assemblies 76 of a pipe drum 44 to be moved concurrently in opposite manners, which, as will be described in more detail below, may facilitate improving the efficiency with which drum flanges are secured to the drum body 54 of the pipe drum 44 and/or the efficiency with which a pipe coil 56 is loaded onto pipe deployment equipment 42.

However, it should be appreciated that the depicted example is merely intended to be illustrative and not limiting. In particular, in other embodiments, the fluid power sub-system 88D of FIG. 10 may include more than two (e.g., three, four, or more) actuation fluid pumps 94 and more than two actuation fluid valves 96, for example, when a corresponding pipe drum includes more than two actuator sets 118. Additionally, as mentioned above, in some embodiments, an actuator 78 of a pipe drum 44 may not be secured directly to a corresponding paddle assembly 76. In fact, in some such embodiments, the drum body 54 of a pipe drum 44 may be implemented to enable a single actuator 78 to control movement (e.g., extension and/or retraction) of multiple paddle assemblies 76.

Figure 11:
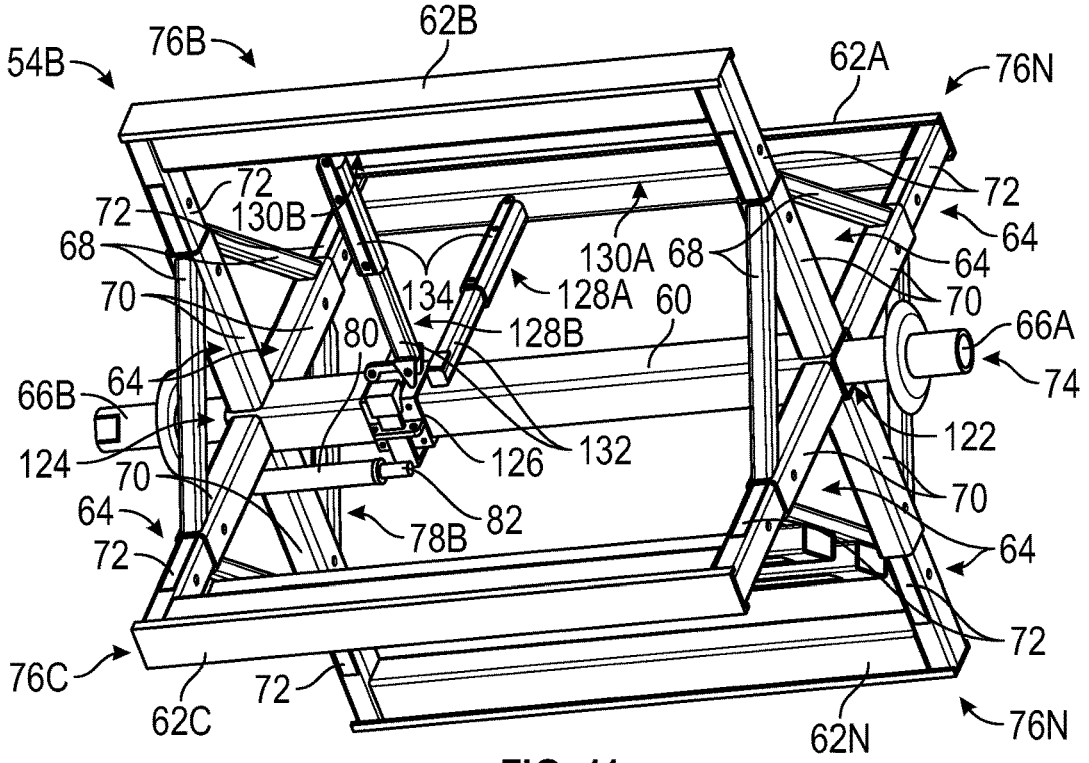
FIG. 11 is a perspective view of another example of the pipe drum of FIG. 5 with two of its paddle assemblies in an (e.g., fully or partially) extended states, in accordance with an embodiment of the present disclosure.
Figure 12:
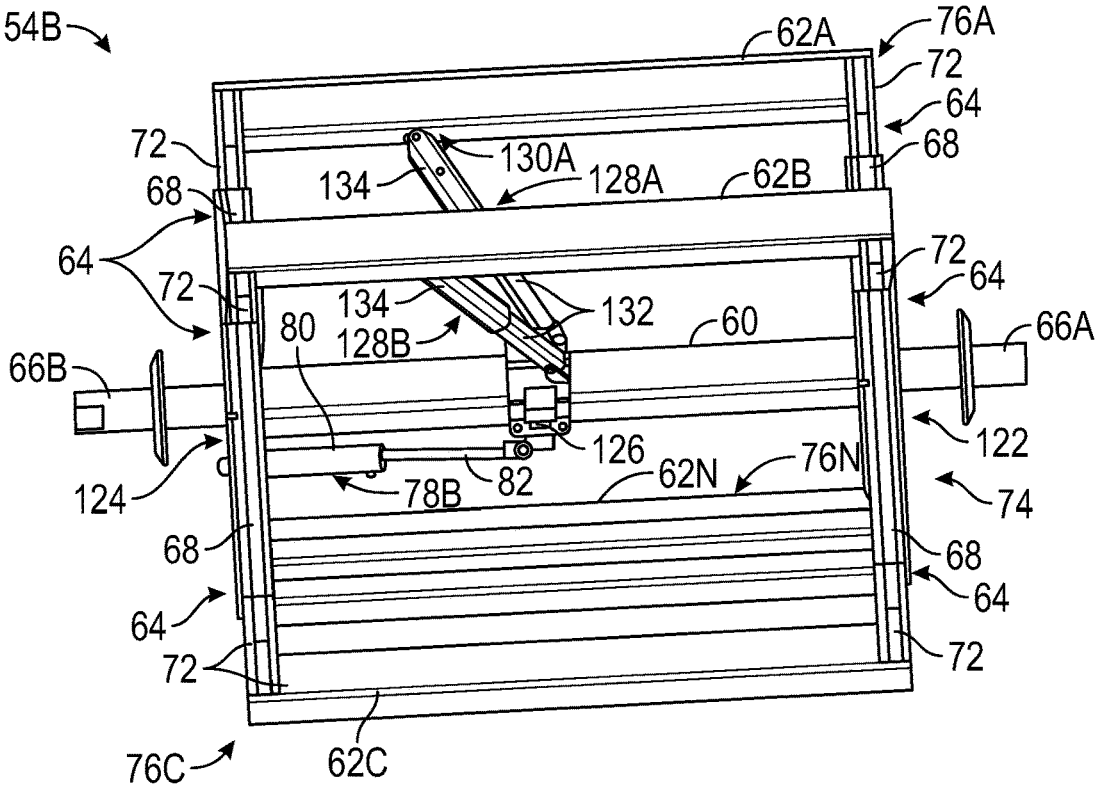
FIG. 12 is a perspective view of the pipe drum of FIG. 11 with its paddle assemblies in retracted states, in accordance with an embodiment of the present disclosure.

To help illustrate, a portion of another example of a drum body 54B, which may be included in a pipe drum 44, is shown in FIGS. 11 and 12. In particular, FIG. 11 shows the drum body 54B with its first paddle assembly 76A and its second paddle assembly 76B in an (e.g., fully or partially) extended state. On the other hand, FIG. 12 shows the drum body 54B with its first paddle assembly 76A and its second paddle assembly 76B in a retracted state.

Similar to FIG. 6, as depicted in FIGS. 11 and 12, the drum body 54B includes a third paddle assembly 76C and an Nth paddle assembly 76N in addition to the first paddle assembly 76A and the second paddle assembly 76B. In particular, similar to FIG. 6, as depicted in FIGS. 11 and 12, each paddle assembly 76 of the drum body 54B includes a corresponding drum paddle 62 and the male sections 72 of each expandable body spoke 64 that is secured to the corresponding drum paddle 62. Additionally, similar to FIG. 6, as depicted in FIGS. 11 and 12, the drum core 74 of the drum body 54B includes an axial support bar 60 and the female sections 70 of each expandable body spoke 64, for example, in addition to a first drum shaft 66A that extends out from a first end 122 of the axial support bar 60, a second drum shaft 66B that extends out from a second end 124 of the axial support bar 60, and circumferential support bars 68 secured between adjacent expandable body spokes 64. In fact, in some embodiments, the drum core 74 of FIGS. 11 and 12 may generally match the drum core 74 of FIG. 6 and/or the paddle assemblies 76 of FIGS. 11 and 12 may generally match the paddle assemblies 76 of FIG. 6.

However, in FIGS. 11 and 12, the depicted fluid actuator 78B is not secured directly to its corresponding paddle assemblies 76. Instead, in the depicted examples, the actuator cylinder 80 of the depicted fluid actuator 78 is secured to the drum core 74 while the actuator piston 82 of the depicted fluid actuator 78 is secured to a slidable ring 126, which is slidably disposed around the axial support bar 60. Additionally, to facilitate controlling movement of the first paddle assembly 76A via the depicted fluid actuator 78, a first pivoting member 128A is pivotably connected to the slidable ring 126 via a pivotable fastener, such as a nut and bolt pair, and pivotably connected to a first securement point 130A on the inner surface of a first drum paddle 62A in the first paddle assembly 76A via a pivotable fastener, such as a nut and bolt pair. Similarly, to facilitate controlling movement of the second paddle assembly 76B via the depicted fluid actuator 78, a second pivoting member 128B is pivotably connected to the slidable ring 126 via a pivotable fastener, such as a nut and bolt pair, and pivotably connected to a second securement point 130B on the inner surface of a second drum paddle 62B in the second paddle assembly 76B via a pivotable fastener, such as a nut and bolt pair.

Generally, a pivoting member 128 of a drum body 54 may be implemented using rigid material, such as metal. As such, the length of the pivoting member 128 may generally be fixed once it has been set, for example, at least in part by inserting a pin through a male section 132 and a female section 134 of the pivoting member 128. Thus, as depicted in FIG. 12, when the depicted fluid actuator 78B is operated to move the slidable ring 126 away from alignment with the securement points 130 on the first drum paddle 62A and the second drum paddle 62B, the first pivoting member 128A causes the first paddle assembly 76A to retract and the second pivoting member 128B causes the second paddle assembly 76B to retract. On the other hand, as depicted in FIG. 11, when the depicted fluid actuator 78B is operated to move the slidable ring 126 toward alignment with the securement points 130 on the first drum paddle 62A and the second drum paddle 62B, the first pivoting member 128A causes the first paddle assembly 76A to extend and the second pivoting member 128B causes the second paddle assembly 76B to extend. In this manner, a drum body 54 of a pipe drum 44 may be implemented to enable multiple paddle assemblies 76 to be concurrently moved in the same manner.

However, it should be appreciated that the depicted example is merely intended to be illustrative and not limiting. In particular, although not depicted for clarity purposes, it should be appreciated that, to control movement of the third paddle assembly 76C and the Nth paddle assembly 76N, the drum body 54B of FIGS. 11 and 12 may additionally include another fluid actuator 78, another slidable ring 126, which is slidably disposed around the axial support bar 60, a third pivoting member 128, which is secured between the other slidable ring 126 and a securement point 130 on the inner surface of a third drum paddle 62C in the third paddle assembly 76C, and a fourth pivoting member 128, which is secured between the other slidable ring 126 and a securement point 130 on the inner surface of an Nth drum paddle 62N in the Nth paddle assembly 76N. Additionally, in other embodiments, a fluid actuator 78 may be connected to a corresponding paddle assembly 76 via multiple slidable rings 126 and multiple pivoting members 128. Furthermore, in other embodiments, a slidable ring 126 may be connected to a single paddle assembly 76 of a pipe drum 44, for example, to enable each of the paddle assemblies 76 to be moved independently. Moreover, as mentioned above, in other embodiments, a fluid actuator 78 in the drum body 54 of a pipe drum 44 may include a fluid bladder, for example, instead of an actuator cylinder 80 and an actuator piston 82.

Figure 13:
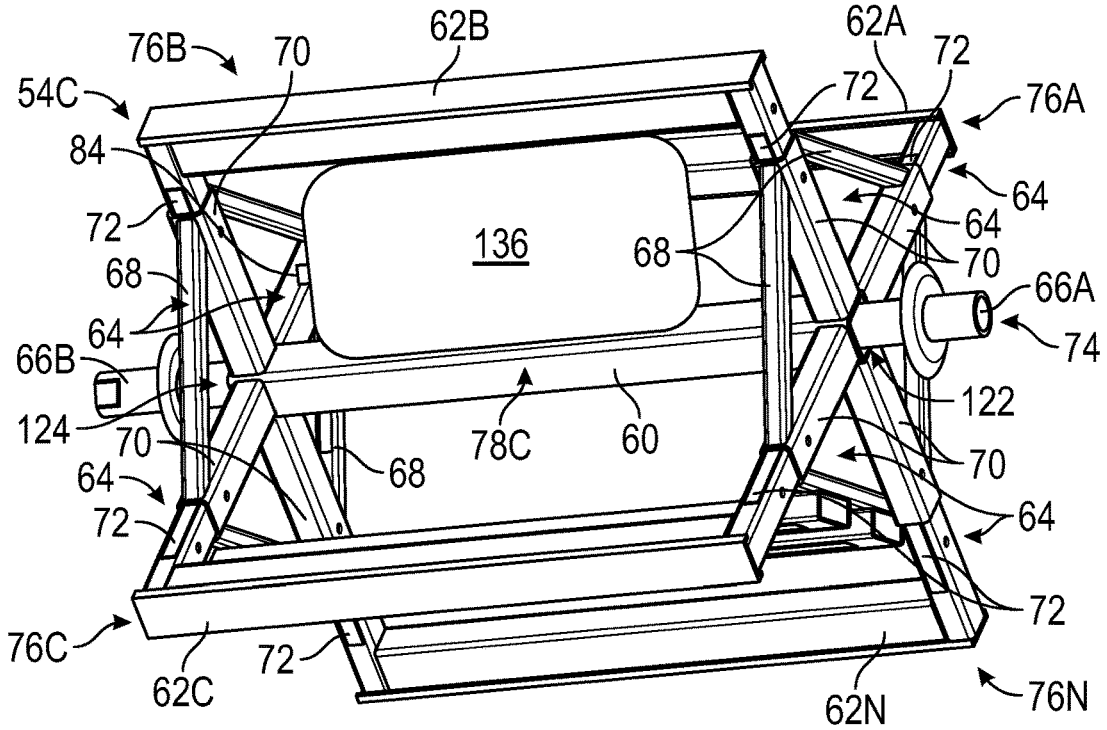
FIG. 13 is a perspective view of another example of the pipe drum of FIG. 5 with its paddle assemblies in their retracted states, in accordance with an embodiment of the present disclosure.
Figure 14:
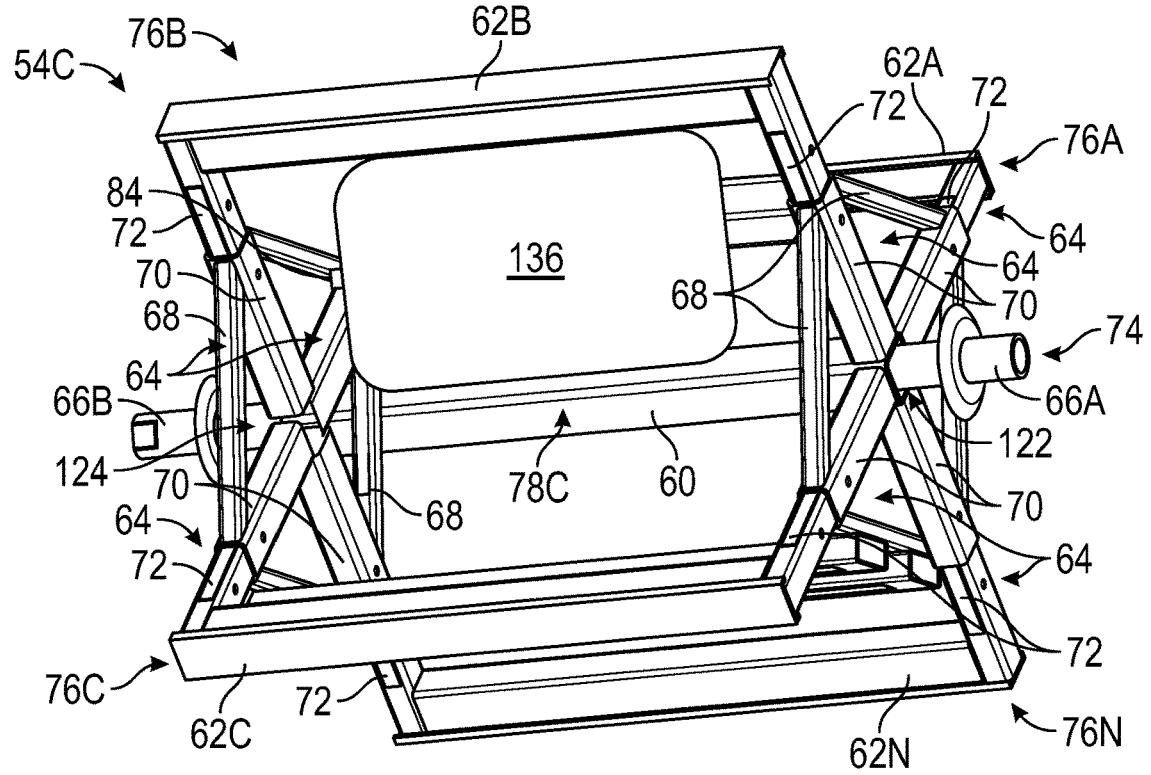
FIG. 14 is a perspective view of the pipe drum of FIG. 13 with a paddle assembly in an (e.g., fully or partially) extended state, in accordance with an embodiment of the present disclosure.

To help illustrate, a portion of another drum body 54C, which may be included in a pipe drum 44, is shown in FIGS. 13 and 14. In particular, FIG. 13 shows the drum body 54C with a paddle assembly 76—namely a second paddle assembly 76B—in a retracted state. On the other hand, FIG. 14 shows the drum body 54C with the second paddle assembly 76B in an (e.g., partially or fully) extended state.

Similar to FIG. 6, as depicted in FIGS. 13 and 14, in addition to the second paddle assembly 76B, the drum body 54C includes a first paddle assembly 76A, a third paddle assembly 76C, and an Nth paddle assembly 76N. In particular, similar to FIG. 6, as depicted in FIGS. 13 and 14, each paddle assembly 76 of the drum body 54C includes a corresponding drum paddle 62 and the male sections 72 of each expandable body spoke 64 that is secured to the drum paddle 62. Additionally, similar to FIG. 6, as depicted in FIGS. 13 and 14, the drum core 74 of the drum body 54C includes an axial support bar 60 and the female sections 70 of each expandable body spoke 64, for example, in addition to a first drum shaft 66A that extends out from a first end 122 of the axial support bar 60, a second drum shaft 66B that extends out from a second end 124 of the axial support bar 60, and circumferential support bars 68 secured between adjacent expandable body spokes 64. In fact, in some embodiments, the drum core 74 of FIGS. 13 and 14 may generally match the drum core 74 of FIG. 6 and/or the paddle assemblies 76 of FIGS. 13 and 14 may generally match the paddle assemblies 76 of FIG. 6.

However, in FIGS. 13 and 14, the depicted fluid actuator 78C of the drum body 54C includes a fluid bladder 136, for example, instead of an actuator cylinder 80 and an actuator piston 82. In particular, as depicted, the fluid bladder 136 is secured between the axial support bar 60 and the inner surface of the second drum paddle 62B in the second paddle assembly 76B. Additionally, a fluid bladder 136 of a fluid actuator 78 included in a drum body 54 may generally be implemented using elastic material, such as rubber.

As such, the fluid bladder 136 may generally increase in size as actuation fluid is supplied thereto. Thus, as depicted in FIG. 14, the second paddle assembly 76B may be extended as actuation fluid is supplied to the fluid bladder 136 via a corresponding fluid port 84, for example, from a retracted state or a less (e.g., partially) retracted state to a more (e.g., fully) extended state. On the other hand, the fluid bladder 136 may generally decrease in size as actuation fluid is extracted therefrom. Thus, as depicted in FIG. 13, the second paddle assembly 76B may be retracted as actuation fluid is extracted from the fluid bladder 136 via a corresponding fluid port 84, for example, from a more extended state to a less extended state or a retracted state.

However, it should be appreciated that the depicted example is merely intended to be illustrative and not limiting. In particular, although not depicted for clarity purposes, it should be appreciated that, to control movement of the first paddle assembly 76A, the third paddle assembly 76C, and the Nth paddle assembly 76N, the drum body 54C of FIGS. 13 and 14 may additionally include a fluid bladder 136 secured between the axial support bar 60 and the inner surface of a first drum paddle 62A in the first paddle assembly 76A, a fluid bladder 136 secured between the axial support bar 60 and the inner surface of a third drum paddle 62C in the third paddle assembly 76C, and a fluid bladder 136 secured between the axial support bar 60 and the inner surface of an Nth drum paddle 62N in the Nth paddle assembly 76N. In any case, in this manner, the present disclosure provides techniques for implementing a drum body 54 of a pipe drum 44 in a pipe deployment system 38 such that the drum body 54 has an adaptively (e.g., dynamically and/or selectively) adjustable outer surface diameter, which, at least in some instances, may facilitate reducing implementation-associated cost (e.g., component count and/or physical footprint) of the pipe deployment system 38, for example, at least in part by enabling the same pipe drum 44 to be used with multiple different pipe coils 56.

Figure 15:
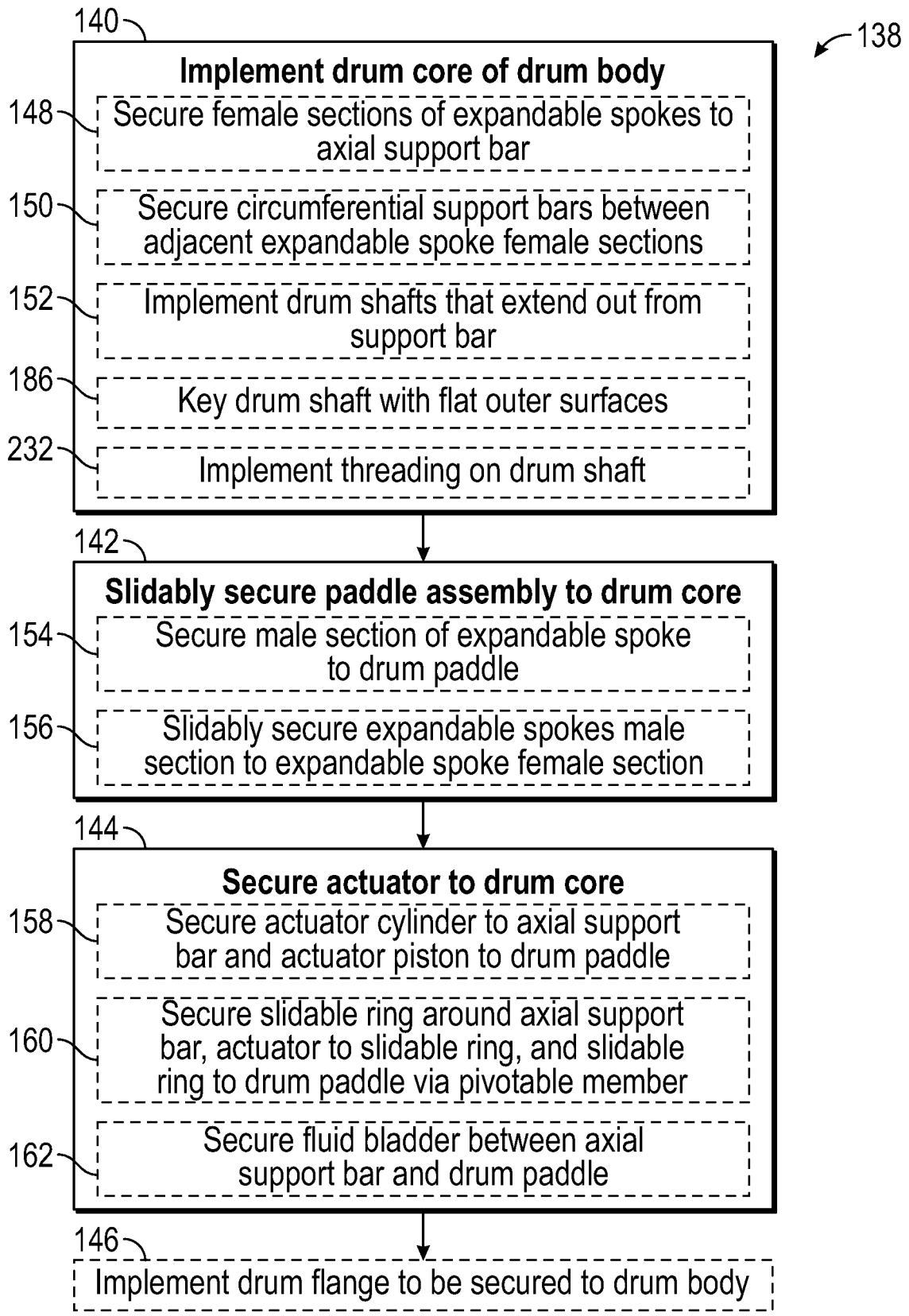
FIG. 15 is a flow diagram of an example of a process for implementing the pipe drum of FIG. 5, in accordance with an embodiment of the present disclosure.

To help further illustrate, an example of a process 138 for implementing a pipe drum 44 is described in FIG. 15. Generally, the process 138 includes implementing a drum core of a drum body (process block 140). Additionally, the process 138 generally includes slidably securing a paddle assembly to the drum core (process block 142) and securing an actuator to the drum core (process block 144).

Although described in a specific order, which corresponds with an embodiment of the present disclosure, it should be appreciated that the example process 138 is merely intended to be illustrative and not limiting. In particular, in other embodiments, a process 138 for implementing a pipe drum 44 may include one or more additional process blocks and/or omit one or more of the depicted process blocks. For example, some embodiments of the process 138 may additionally include implementing a drum flange to be secured to the drum body (process block 146) while other embodiments of the process 138 do not. Moreover, in other embodiments, the depicted process blocks may be performed in a different order, for example, such that the actuator is secured to the drum core before the paddle assembly is slidably secured to the drum core.

In any case, as described above, a pipe drum 44 in a pipe deployment system 38 generally includes a drum body 54 on which a pipe coil 56 can be disposed. In particular, to facilitate adaptive adjusting its outer surface diameter, as described above, the drum body 54 of a pipe drum 44 may be implemented as a drum core 74 and multiple paddle assemblies 76, which are slidably connected to the drum core 74. As such, implementing the pipe drum 44 may include implementing a drum core 74 included in its drum body 54 (process block 140).

In particular, as described above, the drum core 74 of a pipe drum 44 may include an axial support bar 60 as well as the female sections 70 of multiple expandable body spokes 64, which are each secured to the axial support bar 60. As such, implementing the drum core 74 of the pipe drum 44 may generally include securing the female sections 70 of multiple expandable body spokes 64 to an axial support bar 60 (process block 148). For example, the female sections 70 of a first set of multiple expandable body spokes 64 may each be secured at a first end 122 of the axial support bar 60 while the female sections 70 of a second set of multiple expandable body spokes 64 may each be secured at a second (e.g., opposite) end 124 of the axial support bar 60.

As described above, in some embodiments, the drum core 74 of a pipe drum 44 may additionally include circumferential support bars 68 secured between the female sections 70 of adjacent expandable body spokes 64. In other words, in such embodiments, implementing the drum core 74 of the pipe drum 44 may additionally include securing circumferential support bars 68 between the female sections 70 of adjacent expandable body spokes 64 (process block 150). For example, a circumferential support bar 68 may be secured between the female sections 70 of a first expandable body spoke 64 and a second expandable body spoke 64, which are secured at a first end 122 of the axial support bar 60, and another circumferential support bar 68 may be secured between the female sections 70 of an N+1th expandable body spoke 64 and an N+2th expandable body spoke 64, which are secured at a second end 124 of the axial support bar 60.

Furthermore, as described above, in some embodiments, the drum core 74 of a pipe drum 44 may additionally include drum shafts 66 that extend out from its axial support bar 60, for example, to enable a corresponding pipe coil 56 to rotate about a central axis and/or to facilitate securing drum flanges to the drum body 54 of the pipe drum 44. In other words, in such embodiments, implementing the drum core 74 of the pipe drum 44 includes implementing drum shafts 66 that extend out from the axial support bar 60 in the drum core 74 (process block 152). For example, a first drum shaft 66A may be implemented to extend out from a first end 122 of the axial support bar 60 while a second drum shaft 66B may be implemented to extend out from a second (e.g., opposite) end 124 of the axial support bar 60.

In any case, as described above, the drum body 54 of a pipe drum 44 may include multiple paddle assemblies 76 slidably secured to its drum core 74. As such, implementing the drum body 54 may generally include slidably securing multiple paddle assemblies 76 to its drum core 74 (process block 142). In particular, as described above, a paddle assembly 76 of a pipe drum 44 may generally include a corresponding drum paddle 62 and the male sections 72 of each expandable body spoke 64 secured to the drum paddle 62. In other words, a paddle assembly 76 of a pipe drum 44 may be implemented at least in part by securing the male sections 72 of one or more expandable body spokes 64 to a drum paddle 62 (process block 154) and slidably securing a paddle assembly 76 to the drum core 74 may include slidably securing a male section 72 of an expandable body spoke 64 included in the paddle assembly 76 to (e.g., within) the female section 70 of the expandable body spoke 64, which is included in the drum core 74 (process block 156).

To facilitate moving paddle assemblies 76 included in a drum body 54 of a pipe drum 44 and, thus, adaptively adjusting the outer surface diameter of the drum body 54, as described above, the drum body 54 may include one or more actuators 78 secured to its drum core 74. As such, implementing the pipe drum 44 may include securing one or more actuators 78 to its drum core 74 (process block 144). In particular, to facilitate controlling movement of a paddle assembly 76 included in a drum body 54, as described above, in some embodiments, an actuator 78 of the drum body 54 may be secured such that its actuator cylinder 80 is secured to an axial support bar 60 included in the drum core 74 of the drum body 54 and its actuator piston 82 is secured to the inner surface of a drum paddle 62 included in the paddle assembly 76 (process block 158).

However, as described above, in other embodiments, an actuator 78 included in a drum body 54 of a pipe drum 44 may not be secured directly to a corresponding paddle assembly 76. Instead, in some other embodiments, as described above, an actuator 78 in a drum body 54 may be secured to a slidable ring 126, which is slidably disposed around the axial support bar 60 of the drum body 54 and connected to the drum paddles 62 of one or more corresponding paddle assemblies 76 via pivoting members 128. In other words, in such embodiments, securing an actuator 78 to the drum core 74 may include slidably disposing a slidable ring 126 around the axial support bar 60 in the drum core 74, securing the actuator 78 to the slidable ring 126, and securing the slidable ring 126 to the drum paddles 62 of one or more corresponding paddle assemblies 76 via pivoting members 128 (process block 160).

Moreover, as described above, in other embodiments, an actuator 78 in a drum body 54 of a pipe drum 44 may include a fluid bladder 136, for example, instead of an actuator cylinder 80 and an actuator piston 82. In particular, as described above, to facilitate controlling movement of a paddle assembly 76, in such embodiments, the fluid bladder 136 may be secured between the axial support bar 60 of the drum body 54 and the drum paddle 62 included in the paddle assembly 76. In other words, in such embodiments, securing an actuator 78 to the drum core 74 may include securing a fluid bladder 136 between the axial support bar 60 included in the drum core 74 and the drum paddle 62 included in a corresponding paddle assembly 76 (process block 162). In this manner, the drum body 54 of a pipe drum 44 included in a pipe deployment system 38 may be implemented to enable its outer surface diameter to be adaptively adjusted, which, at least in some instances, may facilitate reducing implementation associated cost (e.g., component count and/or physical footprint) of the pipe deployment system 38, for example, at least in part by enabling the same pipe drum 44 to be used with multiple different pipe coils 56.

Nevertheless, in addition to a drum body 54, as described above, in some embodiments, a pipe drum 44 may include one or more drum flanges, which are implemented to be secured to the drum body 54. In other words, in such embodiments, implementing the pipe drum 44 may include implementing a drum flange that is to be secured to its drum body 54 (process block 146). In particular, a drum flange may be secured to the drum body 54 to facilitate retaining a pipe coil 56 on the drum body 54.

Figure 16:
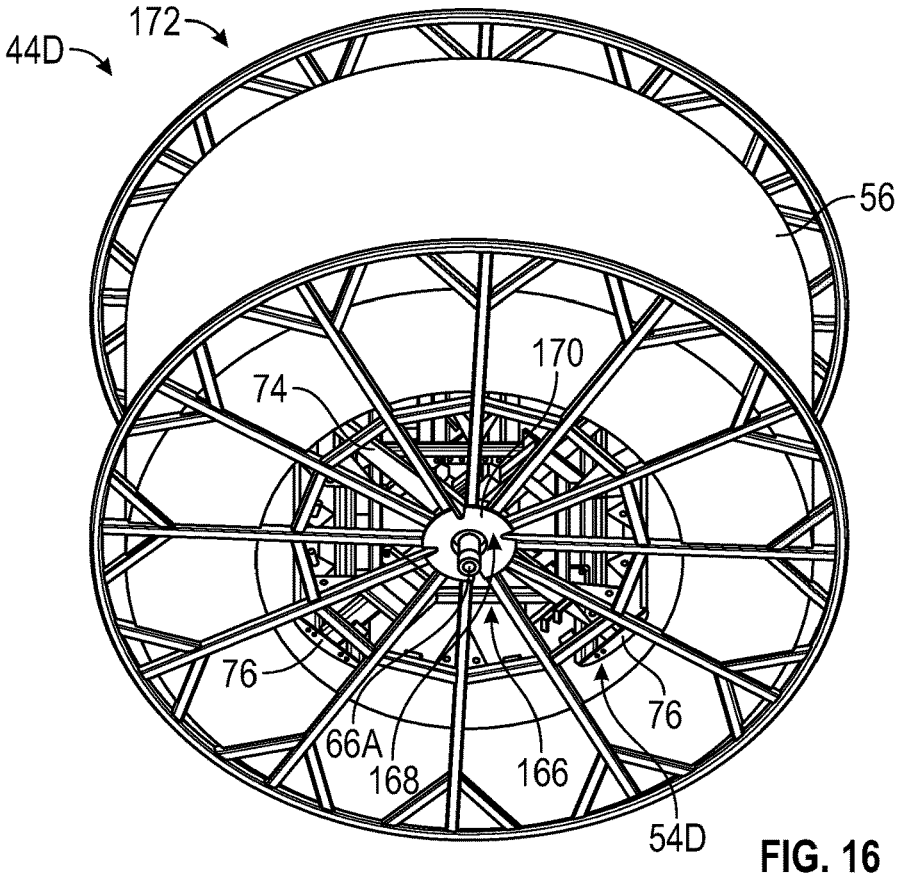
FIG. 16 is a perspective view of another example of a pipe coil spooled on a pipe drum that includes drum flanges, in accordance with an embodiment of the present disclosure.

To help illustrate, a pipe coil 56 disposed on another example of a pipe drum 44D, which may be included in a pipe deployment system 38, is shown in FIG. 16. For clarity purposes, it should be appreciated that the details of the pipe coil 56 are omitted. In any case, similar to FIGS. 6 and 11-14, as depicted in FIG. 16, the pipe drum 44D has a drum body 54D, which includes a drum core 74 and multiple paddle assemblies 76. In fact, in some embodiments, the drum body 54D of FIG. 16 may generally match the drum body 52A of FIG. 6, the drum body 52B of FIGS. 11 and 12, or the drum body 52C of FIGS. 13 and 14.

However, as depicted in FIG. 16, the pipe drum 44D additionally includes drum flanges 164 connected to its drum body 54D. In particular, as in the depicted example, a first drum flange 164 may be connected to a first side 166 of the drum body 54D such that a first drum shaft 66A of the drum body 54D extends through a shaft opening 168 in a flange plate 170 of the first drum flange 164. Similarly, a second drum flange 164 may be connected to a second (e.g., opposite) side of the drum body 54D, for example, such that a second drum shaft 66B of the drum body 54D extends through a flange plate 170 of the second drum flange 164.

However, it should be appreciated that the depicted example is merely intended to be illustrative and not limiting. In particular, in other embodiments, a pipe drum 44 may include a single drum flange 164 connected to its drum body 54. Additionally, although a full pipe coil 56 is depicted, in other instances, a partial pipe coil 56 that has had one or more pipe wraps removed may be disposed on a pipe drum 44. In fact, since drum flanges 164 may be selectively secured to the drum body 54 of a pipe drum 44, in some embodiments, a larger drum flange 164 may be secured to the drum body 54 when the pipe drum 44 is being used to handle a full pipe coil 56 while a smaller drum flange 164 may be secured to the drum body 54 when the pipe drum 44 is being used to handle a partial pipe coil 56. Furthermore, to facilitate inserting a drum shaft 66 of a drum body 54 through a drum flange 164, in other embodiments, the flange plate 170 of the drum flange 164 may be implemented with a non-circular shaft opening 168 and/or a shaft opening 168 that opens to an edge of the flange plate 170.

Figure 17:
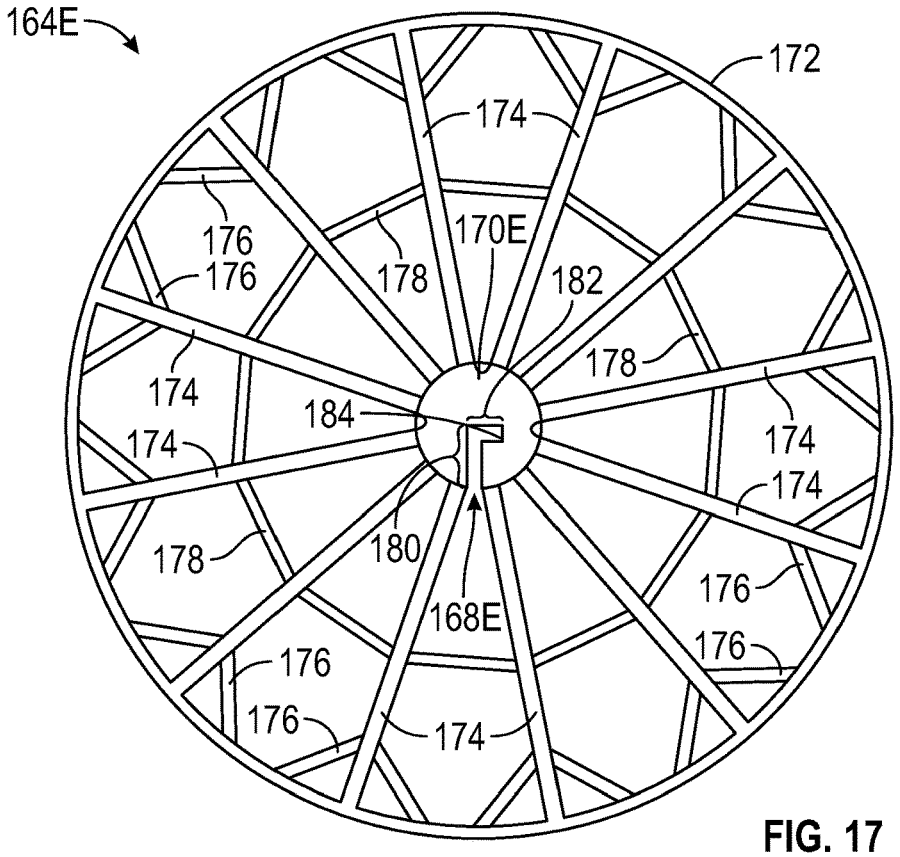
FIG. 17 is a side view of an example of a drum flange of FIG. 16 that includes an L-shaped shaft opening, in accordance with an embodiment of the present disclosure.

To help illustrate, an example of a drum flange 164E, which may be included in a pipe drum 44, is shown in FIG. 17. As depicted, the drum flange 164E includes a flange plate 170E and a flange rim 172, which defines an outer boundary of the drum flange 164E. To facilitate retaining a pipe coil 56 on a corresponding drum body 54, as depicted, the drum flange 164 additionally includes radial support bars 174, which are each secured between the flange plate 170E and the flange rim 172, for example, in addition to rim support bars 176, which are each secured between a corresponding radial support bar 174 and the flange rim 172. Furthermore, as in the depicted example, in some embodiments, a drum flange 164 may additionally include circumferential support bars 178 secured between adjacent radial support bars 174.

However, it should be appreciated that the depicted example is merely intended to be illustrative and not limiting. In particular, in other embodiments, a drum flange 164 may include fewer than twelve (e.g., eleven, ten, or fewer) radial support bars 174 or more than twelve (e.g., thirteen, fourteen, or more) radial support bars 174. Additionally or alternatively, in other embodiments, a drum flange 164 may not include rim support bars 176 and/or circumferential support bars 178.

In any case, in the depicted example, a shaft opening 168E in the flange plate 170E of the drum flange 164E is implemented with an L-shape that opens to an edge of the flange plate 170E. In other words, in such embodiments, implementing a drum flange 164 may include implementing its flange plate 170 with an L-shaped shaft opening 168 that opens to an edge of the flange plate 170. Thus, as will be described in more detail below, in some embodiments, a drum shaft 66 of a drum body 54 may be inserted into the shaft opening 168E at least in part by raising the drum body 54 up to the drum flange 164E and/or lowering the drum body 54 down to the drum flange 164E. In particular, the drum shaft 66 may move through a leg section 180 of the shaft opening 168E in the drum flange 164E when the drum shaft 66 initially enters the shaft opening 168E. When the drum flange 164E is subsequently rotated, the drum shaft 66 may then move from the leg section 180 of the shaft opening 168E to a toe section 182 of the shaft opening 168E. To facilitate securing a drum shaft 66 and, thus, a corresponding drum body 54 to the drum flange 164E, in some embodiments, the drum shaft 66 may be then be secured within the toe section 182 of the shaft opening 168, for example, via a pin.

Moreover, to facilitate tying rotation of a drum flange 164 with the rotation of a drum shaft 66 inserted through its shaft opening 168 and, thus, the rotation of a corresponding drum body 54, in some embodiments, the shaft opening 168 may be matingly interlocked with the drum shaft 66. To facilitate matingly interlocking a shaft opening 168 in a drum flange 164 with a drum shaft 66 of a drum body 54, as in the depicted example, in some embodiments, the shaft opening 168 may be keyed with one or more flat inner surfaces 184 while the drum shaft 66 may be keyed with one or more corresponding flat outer surfaces. Accordingly, returning to the process 138 of FIG. 15, in such embodiments, implementing the drum core 74 of the drum body 54 may include keying a drum shaft 66 of the drum core 74 with one or more flat outer surfaces (process block 186). Additionally, implementing the drum flange 164 may include implementing its flange plate 170 such that it includes a shaft opening 168 that is keyed with one or more flat inner surfaces 184. For example, as in the example depicted in FIG. 17, the shaft opening 168 may be keyed with flat inner surfaces 184 such that the toe section 182 of the shaft opening 168 is defined with a rectangular shape. As such, a corresponding drum shaft 66 may be keyed with four flat outer surfaces and, thus, implemented with a rectangular (e.g., square) cross-sectional shape.

However, it should again be appreciated that the depicted example is merely intended to be illustrative and not limiting. In particular, in other embodiments, a shaft opening 168 of a drum flange 164 may be keyed with more than three (e.g., four, five or more) flat inner surfaces 184 or fewer than three (e.g., two or more) flat inner surfaces 184. Additionally or alternatively, a shaft opening 168 that is keyed with one or more flat inner surfaces 184 may be enclosed within a corresponding flange plate 170, for example, such that the shaft opening 168 has a rectangular (e.g., square) shape, a pentagonal shape, a hexagonal shape, an octagonal shape, or the like. In any case, as mentioned above, in some embodiments, including a drum flange 164 in a pipe drum 44 may facilitate lifting a pipe coil 56 and/or loading the pipe coil 56 onto pipe deployment equipment 42 included in a pipe deployment system 38.

Figure 18:
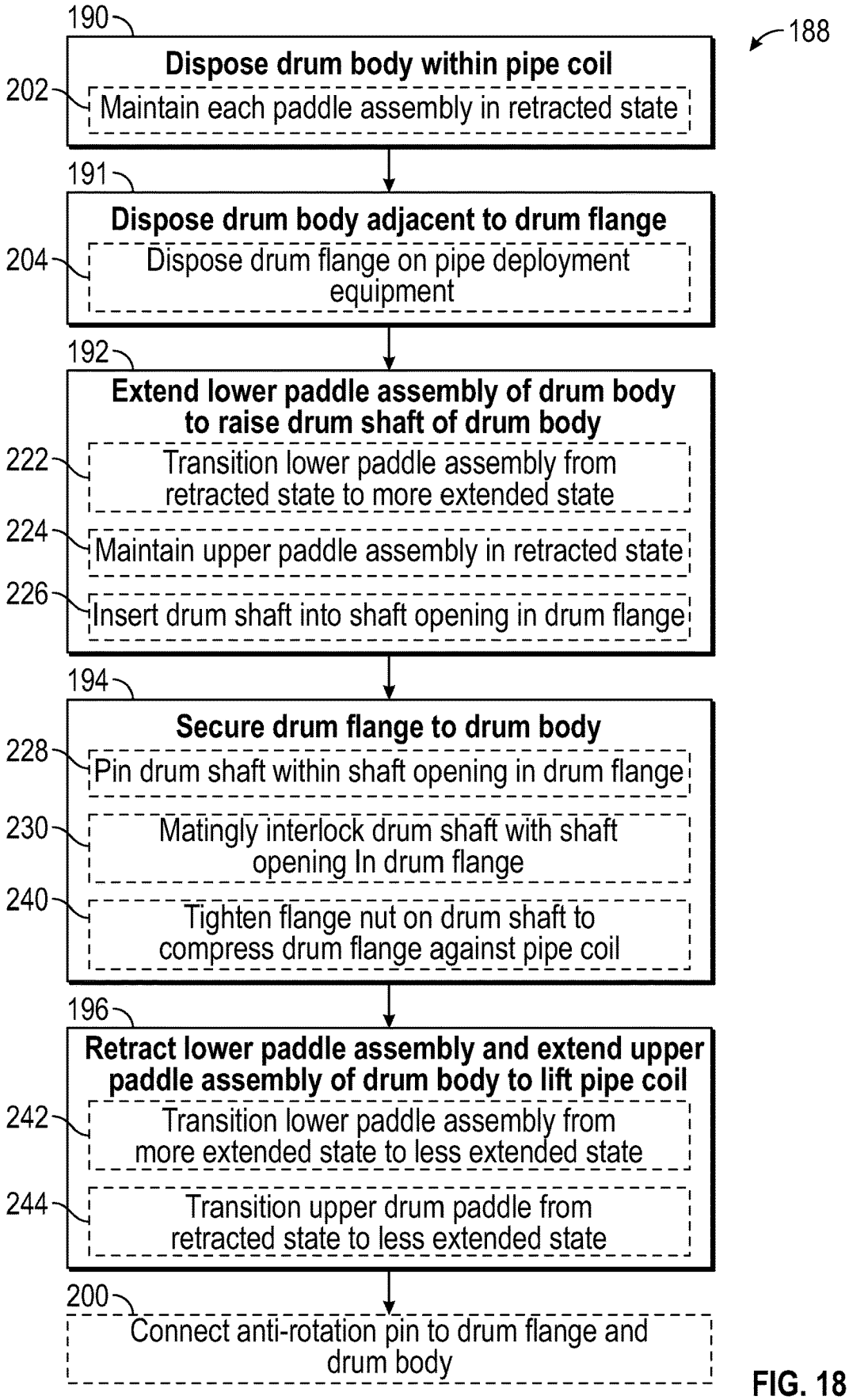
FIG. 18 is a flow diagram of an example of a process for operating a pipe deployment system that includes a pipe drum, in accordance with an embodiment of the present disclosure.

To help illustrate, an example of a process 188 for operating a pipe deployment system 38 is described in FIG. 18. Generally, the process 188 includes disposing a drum body within a pipe coil (process block 190), disposing the drum body adjacent a drum flange (process block 191), and extending a lower paddle assembly of drum body to raise a drum shaft of the drum body (process block 192). Additionally, the process 188 generally includes securing the drum flange to the drum body (process block 194) and retracting the lower paddle assembly and extending an upper paddle assembly of the drum body to lift the pipe coil (process block 196).

Although described in a specific order, which corresponds with an embodiment of the present disclosure, it should be appreciated that the example process 188 is merely intended to be illustrative and not limiting. In particular, in other embodiments, a process 188 for operating a pipe deployment system 38 may include one or more additional process blocks and/or omit one or more of the depicted process blocks. For example, some embodiments of the process 188 may additionally include connecting an anti-rotation pin to the drum flange and the drum body (process block 200) while other embodiments of the process 188 do not. Moreover, in other embodiments, the depicted process blocks may be performed in a different order, for example, such that lower paddle assembly is extended to raise the drum shaft before the drum body is disposed adjacent to the drum flange.

In any case, as described above, a pipe drum 44 in a pipe deployment system 38 generally includes a drum body 54 on which a pipe coil 56 is to be disposed. In particular, as described above, the drum body 54 may be disposed within an interior channel 58 of the pipe coil 56. As such, operating the pipe deployment system 38 may include disposing the drum body 54 of the pipe drum 44 within the interior channel 58 of a pipe coil 56 (process block 190).

Figure 19:
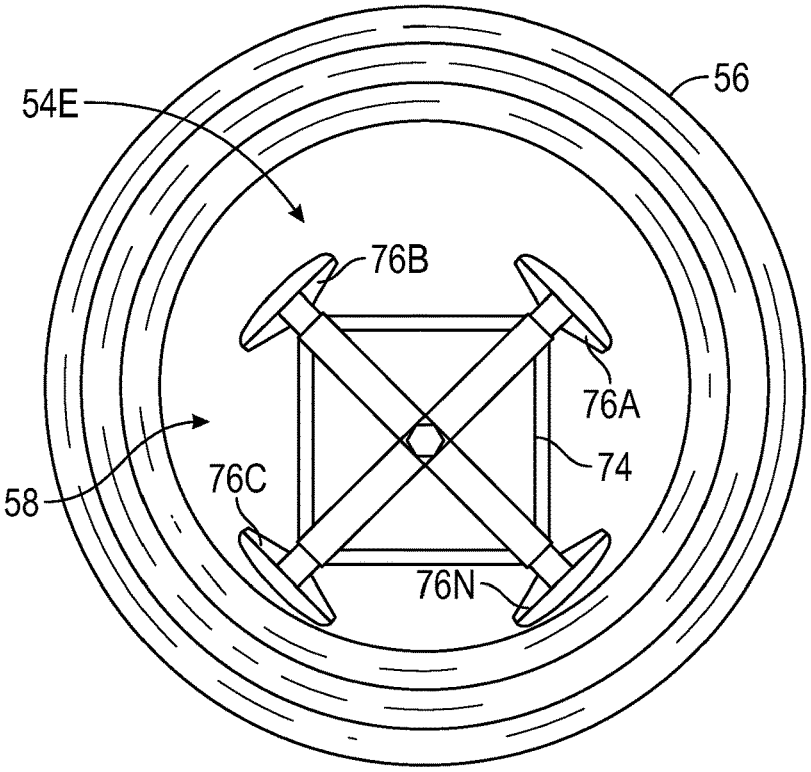
FIG. 19 is a side view of an example of a pipe drum disposed within a pipe coil while its paddle assemblies are in retracted states, in accordance with an embodiment of the present disclosure.

To help illustrate, an example of a drum body 54E disposed within the interior channel 58 of a pipe coil 56 is shown in FIG. 19. Similar to FIGS. 6, 11-14, and 16, as depicted in FIG. 19, the drum body 54E includes a drum core 74 and multiple paddle assemblies 76—namely a first paddle assembly 76A, a second paddle assembly 76B, a third paddle assembly 76C, and an Nth paddle assembly 76N. In fact, in some embodiments, the drum body 54E of FIG. 19 may generally match the drum body 52A of FIG. 6, the drum body 52B of FIGS. 11 and 12, the drum body 52C of FIGS. 13 and 14, or the drum body 52D of FIG. 16.

In any case, as described above, the paddle assemblies 76 of a drum body 54 may be slidably coupled to the drum core 74 of the drum body 54 to enable the outer surface diameter of the drum body 54 to be adaptively adjusted. In particular, as in the depicted example, to enable the drum body 54 to be moved relatively freely within the interior channel 58 of the pipe coil 56 and, thus, the drum body 54 to be inserted into and/or withdrawn from the interior channel 58, in some embodiments, each paddle assembly 76 of the drum body 54 may be maintained in its retracted state to cause the outer surface diameter of the drum body 54 to be substantially smaller than the inner surface diameter of the pipe coil 56. In other words, returning to the process 188 of FIG. 18, in such embodiments, disposing the drum body 54 within the pipe coil 56 may include disposing the drum body 54 within the pipe coil 56 while each of its paddle assemblies 76 is in its retracted state (process block 202).

Additionally, as described above, a drum body 54 of a pipe drum 44 in a pipe deployment system 38 may be secured to one or more drum flanges 164 of the pipe drum 44. As such, operating the pipe deployment system 38 may include disposing the drum body 54 adjacent to one or more drum flanges 164 after the drum body 54 is disposed within the pipe coil 56 (process block 191). For example, the drum body 54 may be disposed between a first drum flange 164 and a second drum flange 164.

Furthermore, as mentioned above, in some embodiments, including one or more drum flanges 164 in a pipe drum 44 may facilitate loading a pipe coil 56 disposed on the drum body 54 of the pipe drum 44 onto pipe deployment equipment 42, such as a pipe deployment trailer or a pipe deployment cradle, in a pipe deployment system 38. In particular, to facilitate loading the pipe coil 56 onto the pipe deployment equipment 42, the one or more drum flanges 164 of the pipe drum 44 may be disposed on the pipe deployment equipment 42. In other words, in such embodiments, disposing the drum body 54 adjacent to the drum flange 164 may include disposing the drum flange 164 on pipe deployment equipment 42 in the pipe deployment system 38 (process block 204).

Figure 20:
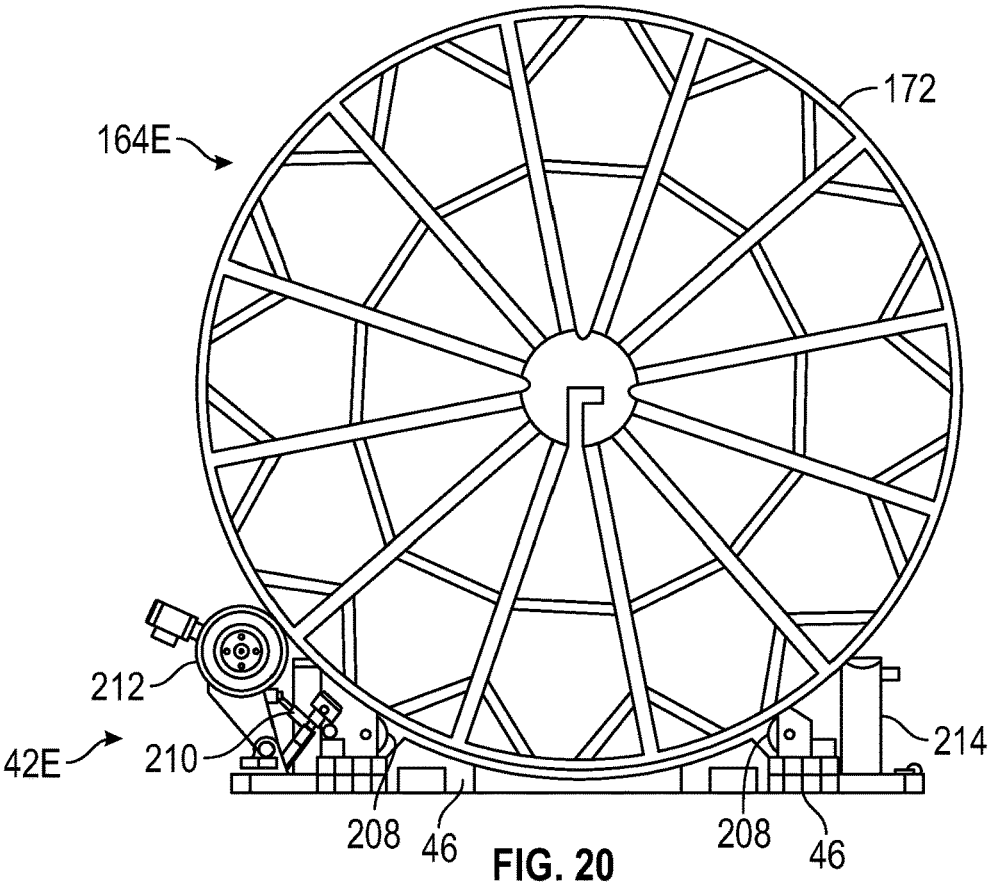
FIG. 20 is a side view of an example of a drum flange of a pipe drum disposed on pipe deployment equipment, in accordance with an embodiment of the present disclosure.

To help illustrate, an example of a drum flange 164E of a pipe drum 44 disposed on pipe deployment equipment 42—namely a pipe deployment cradle 42E—is shown in FIG. 20. In particular, as depicted, the drum flange 164E is disposed on an equipment frame 46E of the pipe deployment cradle 42E. To facilitate supporting the drum flange 164, as in the depicted example, in some embodiments, pipe deployment equipment 42 may additionally include rollers 208 rotatably secured to its equipment frame 46E.

Furthermore, as in the depicted example, to facilitate controlling rotation of the drum flange 164 and, thus, the pipe drum 44, in some embodiments, pipe deployment equipment 42 may additionally include a spooling assembly 210 and/or a braking assembly 212, which are implemented and/or operated to selectively engage the flange rim 172 of the drum flange 164 and secured to the equipment frame 46E. In particular, in such embodiments, the braking assembly 210 may be used to selectively engage the flange rim 172 to slow or stop rotation of the drum flange 164 while the spooling assembly 212 may be used to selectively engage the flange rim 172 to drive rotation of the drum flange 164. Moreover, as in the depicted example, to facilitate guiding a pipe segment 20 as it is being spooled onto and/or off of a drum body 54 due to rotation of a corresponding drum flange 164, in some embodiments, pipe deployment equipment may additionally include a pipe guide 214 secured to its equipment frame 46E.

However, it should be appreciated that the depicted example is merely intended to be illustrative and not limiting. In particular, in other embodiments, pipe deployment equipment 42 in a pipe deployment system 38 may not include in a braking assembly 210, a spooling assembly 212, a pipe guide 214, or any combination thereof. Additionally, in other embodiments, a drum flange 164 may be disposed on a different type of pipe deployment equipment 42 in a pipe deployment system 38, such as pipe deployment trailer. In any case, returning to the process 188 of FIG. 18, the pipe deployment system 38 may then be operated to extend a lower paddle assembly 76 of the drum body 54 to raise a drum shaft 66 of the drum body 54 (process block 192).

Figure 21:
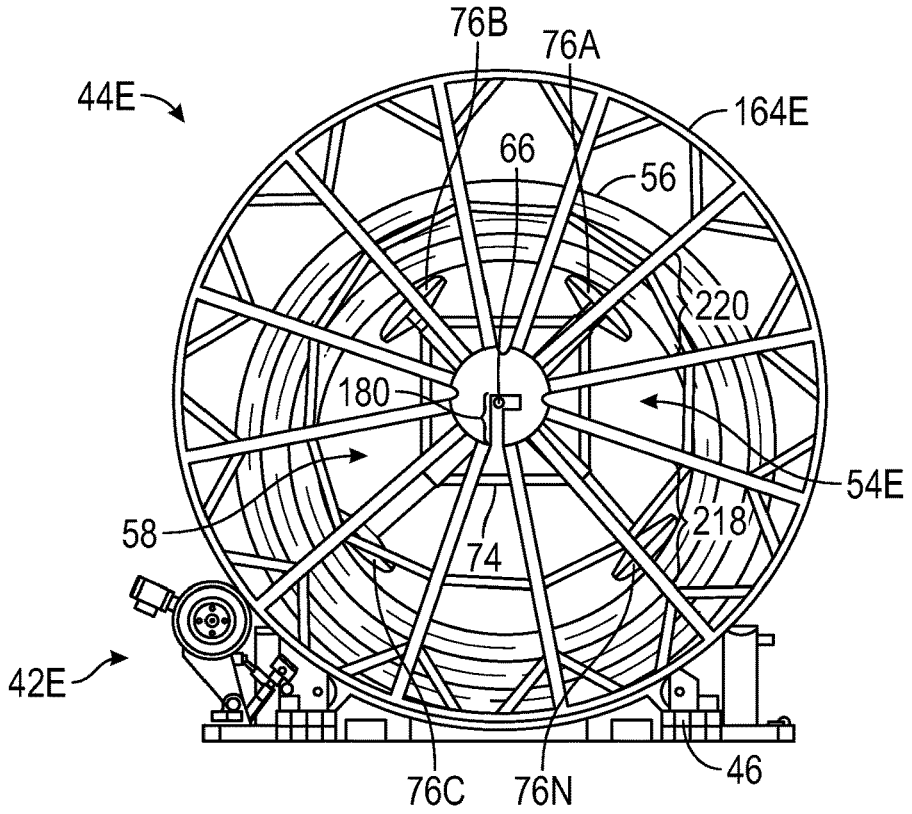
FIG. 21 is a side view of an example of a pipe drum disposed on pipe deployment equipment while its lower paddle assemblies are in more (e.g., fully) extended states and its upper paddle assemblies are in retracted states, in accordance with an embodiment of the present disclosure.

To help illustrate, an example of a pipe drum 44E disposed on pipe deployment equipment 42—namely a pipe deployment cradle 42E—is shown in FIG. 21. As in FIG. 20, a drum flange 164E of the pipe drum 44E in FIG. 21 is disposed on the equipment frame 46E of the pipe deployment cradle 42E. Additionally, as in FIG. 19, the drum body 54E of the pipe drum 44E in FIG. 21, which includes a drum core 74, a first paddle assembly 76A, a second paddle assembly 76B, a third paddle assembly 76C, and an Nth paddle assembly 76N, is disposed within the interior channel 58 of a pipe coil 56.

However, as depicted in FIG. 21, the paddle assemblies 76 in a lower paddle assembly set 218—namely the third paddle assembly 76C and the Nth paddle assembly 76N—are more extended than the paddle assemblies 76 in FIG. 19. Additionally, as in the example depicted in FIG. 21, in some embodiments, the paddle assemblies 76 in an upper paddle assembly set 220—namely the first paddle assembly 76A and the second paddle assembly 76B—may be maintained at approximately the same extension state as the paddle assemblies 76 in FIG. 19. In other words, returning to the process 188 of FIG. 18, in such embodiments, extending a lower paddle assembly 76 (e.g., third paddle assembly 76C and/or Nth paddle assembly 76N) of the drum body 54 may include transitioning the lower paddle assembly 76 from its retracted state to a more (e.g., fully) extended state (process block 222) while concurrently maintaining an upper paddle assembly 76 (e.g., first paddle assembly 76A and/or second paddle assembly 76B) of the drum body 54 in its retracted state (process block 224). As described above, to facilitate extending a paddle assembly 76 of a drum body 54, in some embodiments, the pipe deployment system 38 may instruct its fluid power sub-system 88 to supply actuation fluid to and/or to extract actuation fluid from one or more fluid actuators 78 corresponding with the paddle assembly 76, for example, via its control sub-system 104.

In any case, as in the example depicted in FIG. 21, expanding each paddle assembly 76 in the lower paddle assembly set 218 of the drum body 54E raises (e.g., lifts) a drum shaft 66 of the drum body 54E. In particular, as in the depicted example, in some embodiments, the drum shaft 66 may be raised such that the drum shaft 66 enters a corresponding shaft opening 168 in a drum flange 164, for example, such that the drum shaft 66 is present within a leg section 180 of the shaft opening 168. In other words, returning to the process 188 of FIG. 18, in such embodiments, extending the lower paddle assembly 76 of the drum body 54 may include inserting a drum shaft 66 of the drum body 54 into a shaft opening 168 in a corresponding drum flange 164 (process block 226). However, in other embodiments, the pipe deployment system 38 may be operated to separately insert a drum shaft 66 of the drum body 54 into a shaft opening 168 in a corresponding drum flange 164, for example, via a crane or an excavator.

In any case, the drum flange 164 of the pipe drum 44 may then be secured to the drum body 54 of the pipe drum 44 (process block 194). In particular, as described above, in some embodiments, a drum flange 164 may be secured to a drum body 54 at least in part by pinning a drum shaft 66 of the drum body 54 in a shaft opening 168 of the drum flange 164 (process block 228). For example, after the drum shaft 66 is inserted into a leg section 180 of the shaft opening 168, in some such embodiments, the drum flange 164 may be rotated to cause the drum shaft 66 to move into a toe section 182 of the shaft opening 168. A pin may then be inserted through the drum shaft 66 to pin the drum shaft 66 within the toe section 182 of the shaft opening 168, thereby facilitating securement of the drum flange 164 to the drum body 54.

Additionally, as described above, to facilitate tying rotation of a drum flange 164 to rotation of a corresponding drum body 54, in some embodiments, a shaft opening 168 in the drum flange 164 and a corresponding drum shaft 66 of the drum body 54 may be implemented to matingly interlock. In particular, as described above, in some such embodiments, the shaft opening 168 in the drum flange 164 may be keyed with one or more flat inner surfaces 184 while the drum shaft 66 of the drum body 54 may be keyed with one or more corresponding flat outer surfaces. In other words, in such embodiments, securing the drum flange 164 to the drum body 54 may include matingly interlocking a drum shaft 66 of the drum body 54 with a corresponding shaft opening 168 in the drum flange 164 (process block 230).

However, as mentioned above, in other embodiments, a drum body 54 may be implemented to be secured to a drum flange 164 using a different technique. For example, in some other embodiments, a drum flange 164 may be secured to a drum body 54 via threading implemented on a drum shaft 66 of the drum body 54 and a flange nut. In other words, returning to the process 138 of FIG. 15, in such embodiments, implementing the drum core 74 of a drum body 54 may include implementing threading on a drum shaft 66 of the drum core 74 (process block 232).

Figure 22:
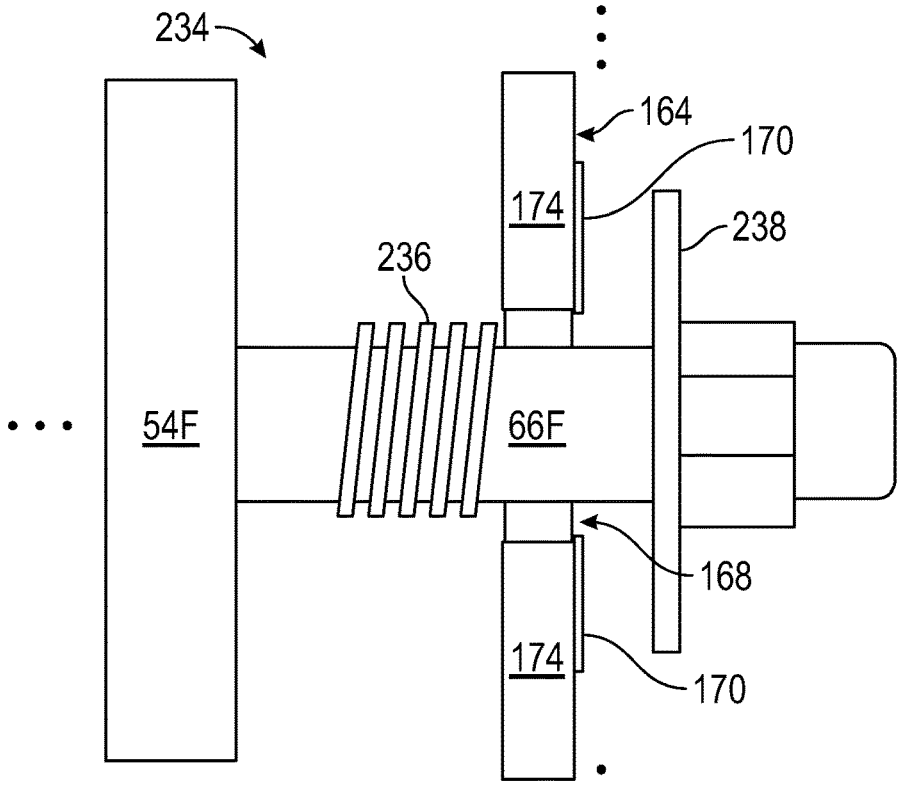
FIG. 22 is a partial cross-section of a portion of a pipe drum that includes a drum flange, a threaded drum shaft, and a flange nut, in accordance with an embodiment of the present disclosure.

To help illustrate, an example of a portion 234 of a drum body 54F and a drum flange 164 is shown in FIG. 22. Similar to FIG. 17, as depicted in FIG. 22, the drum flange 164 includes a flange plate 170, which defines a shaft opening 168, and radial support bars 174, which are secured to the flange plate 170. Additionally, similar to FIG. 16, as depicted in FIG. 22, the drum body 54F includes a drum shaft 66F, which is implemented to be inserted through the shaft opening 168 in the drum flange 164.

However, as depicted in FIG. 22, shaft threading 236 is implemented along the outer surface of the drum shaft 66F. Furthermore, as in the depicted example, in some embodiments, a pipe drum 44 may additionally include a flange nut 238, which is implemented to matingly interlock with the shaft threading 236 on a drum shaft 66 of its drum body 54. In other words, returning to the process 188 of FIG. 18, in such embodiments, securing the drum flange 164 to the drum body 54 may include tightening a flange nut 238 on a drum shaft 66 such that the drum flange 164 is compressed against a pipe coil 56 loaded on the drum body 54 (process block 240). In any case, after the drum flange 164 is secured to the drum body 54, the pipe deployment system 38 may then be operated to retract the lower paddle assembly 76 and to extend an upper paddle assembly 76 of the drum body 54 to lift the pipe coil 56 loaded on the drum body 54 (process block 196).

Figure 23:
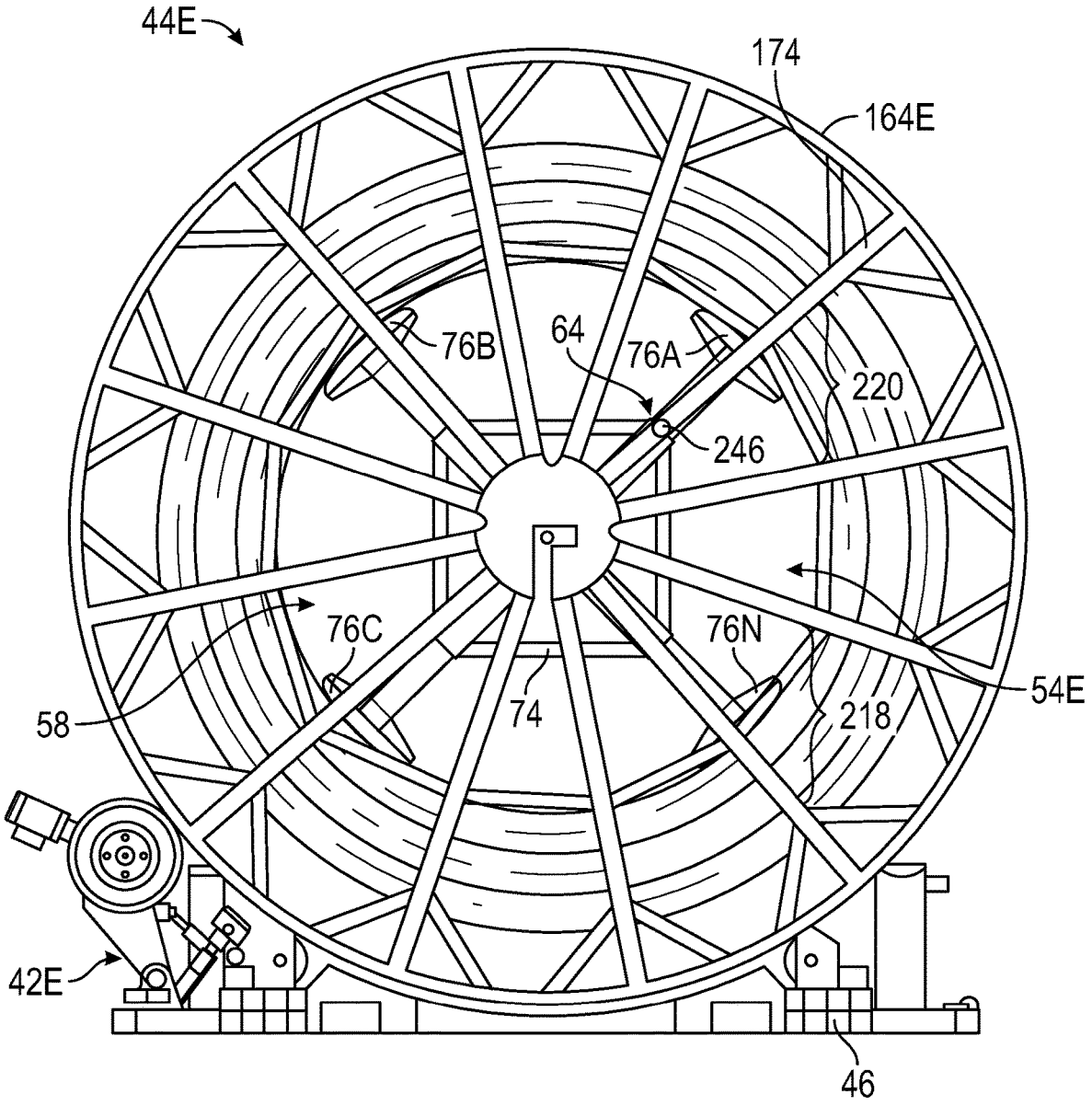
FIG. 23 is a side view of a pipe drum disposed on pipe deployment equipment while its paddle assemblies are each in an (e.g., partially) extended states, in accordance with an embodiment of the present disclosure.

To help illustrate, another example of a pipe drum 44E disposed on pipe deployment equipment 42—namely a pipe deployment cradle 42E—is shown in FIG. 23. As in FIG. 21, a drum flange 164E of the pipe drum 44E in FIG. 21 is disposed on the equipment frame 46E of the pipe deployment cradle 42E. Additionally, as in FIGS. 19 and 21, the drum body 54E of the pipe drum 44E in FIG. 23, which includes a drum core 74, a first paddle assembly 76A, a second paddle assembly 76B, a third paddle assembly 76C, and an Nth paddle assembly 76N, is disposed within the interior channel 58 of a pipe coil 56.

However, as depicted in FIG. 23, the paddle assemblies 76 in a lower paddle assembly set 218—namely the third paddle assembly 76C and the Nth paddle assembly 76N—are more extended than the paddle assemblies 76 in FIG. 19 and less extended than the paddle assemblies 76 in the lower paddle assembly set 218 of FIG. 21. Additionally, as depicted in FIG. 23, the paddle assemblies 76 in an upper paddle assembly set 220—namely the first paddle assembly 76A and the second paddle assembly 76B—are more extended than the paddle assemblies 76 in FIG. 19 and the paddle assemblies 76 in the upper paddle assembly set 220 of FIG. 21. In other words, returning to the process 188 of FIG. 18, retracting the lower paddle assembly 76 and extending the upper paddle assembly 76 may include transitioning the lower paddle assembly 76 from its more (e.g., fully) extended state to its less (e.g., partially) extended state (process block 242) and transitioning the upper paddle assembly 76 from its retracted state to its less (e.g., partially) extended state (process block 244).

As described above, to facilitate extending and/or retracting a paddle assembly 76 of a drum body 54, in some embodiments, the pipe deployment system 38 may instruct its fluid power sub-system 88 to supply actuation fluid to and/or to extract actuation fluid from a fluid actuator 78 corresponding with the paddle assembly 76, for example, via its control sub-system 104. In particular, as described above, in some embodiments, the fluid power sub-system 88 may be implemented and/or operated to enable the lower paddle assembly 76 to retract while the upper paddle assembly 76 is concurrently being extended, which, at least in some instances, may facilitate reducing duration and, thus, improving efficiency of the coil lifting process. Nevertheless, in other embodiments, the pipe deployment system 38 may operate to retract the lower paddle assembly 76 before extending the upper paddle assembly 76.

In any case, as in the example depicted in FIG. 23, retracting each paddle assembly 76 in the lower paddle assembly set 218 of the drum body 54E and extending each paddle assembly 76 in the upper paddle assembly set 220 raises the pipe coil 56 loaded on the drum body 54E. In particular, as depicted, the pipe coil 56 is lifted off of the equipment frame 46E of the pipe deployment cradle 42E, for example, such that the pipe coil 56 is relatively centered on the drum flange 164E. In this manner, a pipe deployment system 38 may be operated to facilitate loading a pipe coil 56 on pipe deployment equipment 42, such as a pipe deployment trailer or a pipe deployment cradle 42E, in the pipe deployment system 38.

To facilitate controlling pipe deployment from a pipe drum 44 that is loaded on pipe deployment equipment 42, as described above, in some embodiments, the pipe deployment equipment 42 may include a spooling assembly 212 and/or a braking assembly 210, which are each implemented and/or operated to selectively engage the flange rim 172 of a drum flange 164. In other words, to facilitate controlling pipe deployment from the pipe drum 44, in such embodiments, rotation of the drum flange 164 may be tied with rotation of the drum body 54 of the pipe drum 44. As described above, in some embodiments, rotation of a drum flange 164 may be tied with rotation of a drum body 54 at least in part by matingly interlocking a drum shaft 66 of the drum body 54 with a shaft opening 168 in the drum flange 164.

However, as mentioned above, rotation of a drum flange 164 may additionally or alternatively be tied to rotation of a drum body 54 via one or more anti-rotation pins connected to the drum flange 164 and the drum body 54. In other words, in such embodiments, operating the pipe deployment system 38 may include connecting an anti-rotation pin to the drum flange 164 and the drum body 54 (process block 200). In particular, as in the example depicted in FIG. 23, in some such embodiments, an anti-rotation pin 246 may be inserted and secured within a pin opening in a radial support bar (e.g., spoke) 174 of the drum flange 164 and a corresponding pin opening in an expandable body spoke 64 of the drum body 54. However, in other embodiments, an anti-rotation pin 246 may be inserted and secured between a pair of adjacent radial support bars 174 of the drum flange 164 such that the anti-rotation pin 246 extends between a pair of adjacent expandable body spokes 64 in the drum body 54. In this manner, a pipe drum 44 in a pipe deployment system 38 may be implemented and/or operated to facilitate selectively loading a pipe coil 56 onto pipe deployment equipment 42, which, at least in some instances may facilitate reducing implementation-associated cost (e.g., physical footprint and/or component count) of the pipe deployment system 38, for example, by enabling the same pipe drum 44 to be used with multiple different pipe coils 56.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A pipe deployment system comprising:

pipe deployment equipment configured to facilitate deploying a pipe segment comprising tubing that defines a pipe bore and a fluid conduit within an annulus of the tubing from a pipe coil into a pipeline system; and a pipe drum comprising a drum body around which the pipe coil is configured to be disposed, wherein:

the pipe drum is configured to be disposed on an equipment frame of the pipe deployment equipment; and the drum body comprises a drum core, a lower paddle assembly slidably secured to the drum core, and an upper paddle assembly slidably secured to the drum core, wherein the pipe deployment system is configured to:

maintain the lower paddle assembly and the upper paddle assembly in a retracted state to enable the drum body to be inserted into an interior channel of the pipe coil;

extend the lower paddle assembly from the retracted state to a more extended state while maintaining the upper paddle assembly in the retracted state to facilitate raising a drum shaft included in the drum core of the drum body; and retract the lower paddle assembly from the more extended state to a less extended state and extend the upper paddle assembly from the retracted state to the less extended state to facilitate lifting the pipe coil disposed on the drum body off of the equipment frame of the pipe deployment equipment.

2. The pipe deployment system of claim 1, wherein the drum body of the pipe drum comprises:

a first fluid actuator secured to the drum core of the drum body, wherein the first fluid actuator is configured to facilitate selectively extending the lower paddle assembly, retracting the lower paddle assembly, or both; and a second fluid actuator secured to the drum core of the drum body, wherein the second fluid actuator is configured to facilitate selectively extending the upper paddle assembly, retracting the lower paddle assembly, or both.

3. The pipe deployment system of claim 2, wherein:

the drum core of the drum body comprises an axial support bar, a first female section of a first expandable body spoke that is secured to the axial support bar, and a second female section of a second expandable body spoke that is secured to the axial support bar, wherein the drum shaft of the drum core extends out from the axial support bar;

the first fluid actuator comprises a first actuator cylinder secured to the axial support bar and a first actuator piston secured to a first inner surface of a lower drum paddle included in the lower paddle assembly; and the second fluid actuator comprises a second actuator cylinder secured to the axial support bar and a second actuator piston secured to a second inner surface of an upper drum paddle included in the upper paddle assembly.

4. The pipe deployment system of claim 3, wherein:

the lower paddle assembly of the drum body comprises the lower drum paddle and a first male section of the first expandable body spoke that is secured to the first inner surface of the lower drum paddle; and the upper paddle assembly of the drum body comprises the upper drum paddle and a second male section of the second expandable body spoke that is secured to the second inner surface of the upper drum paddle.

5. The pipe deployment system of claim 2, wherein:

the first fluid actuator comprises a first fluid bladder secured between the drum core and the lower paddle assembly of the drum body; and the second fluid actuator comprises a second fluid bladder secured between the drum core and the upper paddle assembly of the drum body.

6. The pipe deployment system of claim 2, comprising a fluid power sub-system fluidly connected to the pipe drum via one or more external fluid conduits.

7. The pipe deployment system of claim 1, wherein:

the drum core of the drum body comprises an axial support bar, wherein the drum shaft of the drum core extends out from the axial support bar; and the drum body of the pipe drum comprises:

an actuator secured to the drum core;

a slidable ring slidably disposed around the axial support bar, wherein the actuator is secured to the slidable ring; and a pivoting member pivotably secured to the slidable ring via a first pivotable fastener and to a securement point on an inner surface of a drum paddle in the lower paddle assembly via a second pivoting member.

8. The pipe deployment system of claim 7, wherein the pipe deployment system is configured to:

operate the actuator to move the slidable ring toward alignment with the securement point on the inner surface of the drum paddle in the lower paddle assembly to facilitate extending the lower paddle assembly; and operate the actuator to move the slidable ring away from alignment with the securement point on the inner surface of the drum paddle in the lower paddle assembly to facilitate retracting the lower paddle assembly.

9. The pipe deployment system of claim 7, wherein the drum body of the pipe drum comprises:

another actuator secured to the drum core;

another slidable ring slidably disposed around the axial support bar, wherein the other actuator is secured to the other slidable ring; and another pivoting member pivotably secured to the slidable ring via a third pivotable fastener and to another securement point on another inner surface of another drum paddle in the upper paddle assembly via a fourth pivoting member.

10. The pipe deployment system of claim 1, wherein the pipe drum comprises:

a drum flange configured to be secured to the drum body of the pipe drum to facilitate retaining the pipe coil on the drum body, wherein the drum flange comprises a flange plate that defines a shaft opening; and a flange nut, wherein:

the drum shaft comprises shaft threading implemented along an outer surface of the drum shaft; and the flange nut is configured to matingly interlock with the shaft threading on the drum shaft to facilitate compressing the drum flange against the pipe coil disposed around the drum body.

11. The pipe deployment system of claim 1, wherein the pipe drum comprises a drum flange configured to be secured to the drum body of the pipe drum to facilitate retaining the pipe coil on the drum body, wherein:

the drum flange comprises a flange plate that defines a shaft opening; and the pipe deployment system is configured to extend the lower paddle assembly from the retracted state to the more extended state while maintaining the upper paddle assembly in the retracted state to facilitate raising the drum shaft included in the drum core such that the drum shaft is inserted into the shaft opening in the drum flange.

12. The pipe deployment system of claim 11, wherein the shaft opening in the drum flange has an L-shape comprising:

a leg section that opens to an edge of the flange plate in the drum flange; and a toe section connected to and substantially perpendicular to the leg section, wherein the drum shaft is configured to be pinned in the toe section of the shaft opening to facilitate securing the drum flange to the drum body.

13. A method of operating a pipe deployment system, comprising:

maintaining a lower paddle assembly and an upper paddle assembly of a pipe drum included in the pipe deployment system in a retracted state to enable a drum body of the pipe drum to be inserted into an interior channel of a pipe coil;

extending the lower paddle assembly from the retracted state to a more extended state while maintaining the upper paddle assembly in the retracted state to facilitate inserting a drum shaft of the drum body into a shaft opening in a drum flange of the pipe drum at least in part by raising the drum shaft;

securing the drum flange to the drum body at least in part by securing the drum shaft of the drum body in the shaft opening of the drum flange; and retracting the lower paddle assembly from the more extended state to a less extended state and extending the upper paddle assembly from the retracted state to the less extended state to facilitate lifting the pipe coil disposed around the drum body.

14. The method of claim 13, wherein:

extending the lower paddle assembly from the retracted state to the more extended state comprises instructing a fluid power sub-system of the pipe deployment system to supply actuation fluid to a first cylinder-side fluid port of a first fluid actuator that corresponds with the lower paddle assembly, to extract actuation fluid from a first piston-side fluid port of the first fluid actuator that corresponds with the lower paddle assembly, or both;

retracting the lower paddle assembly from the more extended state to the less extended state comprises instructing the fluid power sub-system to supply actuation fluid to the first piston-side fluid port of the first fluid actuator that corresponds with the lower paddle assembly, to extract actuation fluid from the first cylinder-side fluid port of the first fluid actuator that corresponds with the lower paddle assembly, or both; and extending the upper paddle assembly from the retracted state to the less extended state comprises instructing the fluid power sub-system to supply actuation fluid to a second cylinder-side fluid port of a second fluid actuator that corresponds with the upper paddle assembly, to extract actuation fluid from a second piston-side fluid port of the second fluid actuator that corresponds with the upper paddle assembly, or both.

15. The method of claim 13, wherein retracting the lower paddle assembly from the more extended state to the less extended state and extending the upper paddle assembly from the retracted state to the less extended state comprises retracting the lower paddle assembly while concurrently extending the upper paddle assembly.

16. The method of claim 13, wherein:

extending the lower paddle assembly from the retracted state to the more extended state while maintaining the upper paddle assembly in the retracted state causes the drum shaft of the drum body to be inserted into a leg section of the shaft opening that opens to edge of a flange plate in the drum flange that defines the shaft opening; and securing the drum flange to the drum body comprises:

rotating the drum flange to cause the drum shaft of the drum body to move from the leg section of the shaft opening to a toe section of the shaft opening that is connected to and substantially perpendicular to the leg section; and pinning the drum shaft in the toe section of the shaft opening.

17. The method of claim 13, wherein:

the drum shaft of the drum body is keyed with one or more flat outer surfaces;

a flange plate of the drum flange defines the shaft opening such that the shaft opening is keyed with one or more flat inner surfaces; and securing the drum flange to the drum body comprises matingly interlocking the drum shaft of the drum body with the shaft opening in the drum flange.

* * * * *